US009308430B2

(12) United States Patent
Nivanh

(10) Patent No.: US 9,308,430 B2
(45) Date of Patent: Apr. 12, 2016

(54) ADJUSTABLE GOLF CLUB

(71) Applicant: DUNLOP SPORTS CO., LTD., Kobe-shi, Hyogo (JP)

(72) Inventor: Dan S. Nivanh, Tustin, CA (US)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 30 days.

(21) Appl. No.: 13/665,237

(22) Filed: Oct. 31, 2012

(65) Prior Publication Data

US 2014/0121035 A1 May 1, 2014

(51) Int. Cl.

| | |
|---|---|
| ***A63B 53/02*** | (2015.01) |
| ***A63B 71/06*** | (2006.01) |
| ***A63B 53/00*** | (2015.01) |
| ***A63B 53/04*** | (2015.01) |

(52) U.S. Cl.

CPC ..... *A63B 71/06* (2013.01); *A63B 53/00* (2013.01); *A63B 53/02* (2013.01); *A63B 53/0466* (2013.01); *A63B 2053/023* (2013.01)

(58) Field of Classification Search

CPC ..... A63B 53/09; A63B 53/02
USPC ..... 473/309, 307, 314
See application file for complete search history.

(56) References Cited

U.S. PATENT DOCUMENTS

| | | | | |
|---|---|---|---|---|
| 1,892,482 | A | 12/1932 | Cash, Jr. | |
| 2,027,452 | A | 1/1936 | Rusing | |
| 2,091,794 | A | 8/1937 | Pester | |
| 2,326,495 | A | 8/1943 | Reenstierna | |
| 2,777,694 | A | 1/1957 | Winter | |
| 3,214,169 | A | 10/1965 | Rupnow | |
| 3,931,969 | A * | 1/1976 | Townhill | A63B 53/06 473/246 |
| 4,632,400 | A | 12/1986 | Boone | |
| 4,655,457 | A | 4/1987 | Thompson | |
| 5,451,048 | A | 9/1995 | Magamoto et al. | |
| 5,634,857 | A | 6/1997 | Bradshaw et al. | |
| 6,213,889 | B1 | 4/2001 | Hamburger | |
| 6,623,372 | B1 | 9/2003 | Beebe et al. | |
| 6,752,726 | B2 | 6/2004 | Burrows | |
| 7,789,766 | B2 | 9/2010 | Morris et al. | |
| 8,083,608 | B2 | 12/2011 | Thomas et al. | |
| 8,147,349 | B2 * | 4/2012 | Thomas | A63B 53/00 150/160 |
| 2012/0034995 | A1 | 2/2012 | Harvell et al. | |
| 2012/0034996 | A1 * | 2/2012 | Murphy et al. | 473/307 |
| 2013/0196784 | A1 * | 8/2013 | Clausen et al. | 473/242 |

OTHER PUBLICATIONS

Johsnon, "Cobra debuts AMP Cell metal woods," Golf Digest, Sep. 25, 2012, Available at: http://www.golfdigest.com/golf-equipment/blogs/hotlist365/2012/09/cobra-debuts-amp-cell-metal-wo.html.

* cited by examiner

*Primary Examiner* — Michael Dennis
(74) *Attorney, Agent, or Firm* — Oliff PLC

(57) ABSTRACT

In an embodiment, a golf club includes a striking face, a top portion, a sole portion opposite the top portion, and a shaft assembly. The shaft assembly can include a shaft having a butt end and a tip end, and a shaft sleeve located at the tip end, the shaft sleeve including indicia, and a hosel extending from the top portion. The hosel can include a sidewall, an internal bore for receiving the shaft assembly, and an aperture extending through, and circumscribed by, the sidewall such that the indicia of the shaft sleeve corresponds with the aperture.

24 Claims, 37 Drawing Sheets

B-B'

ADJUSTABLE GOLF CLUB

BACKGROUND

1. Field of the Invention

The present invention relates to golf clubs and more particularly golf clubs having one or more adjustable features.

2. Description of the Related Art

Conventionally, a golf club was static with few options. That is, users bought a golf club with a single configuration for operation. Should the user desire a different type of configuration for the golf club, the user would have to purchase multiple golf clubs or incur significant costs in having a golf professional adjust, e.g. by manual bending of the hosel portion, the golf club.

Reconfigurable golf clubs have been used in order to reduce the need of owning multiple golf clubs, e.g., to account for changes in swing behavior, changes in course conditions, and/or other environmental conditions. For example, some golf clubs are known including shaft assemblies that are repositionable in a plurality of positions for changing characteristics of the club head. For example, a repositionable shaft may include a shaft sleeve adapted to fix the shaft to a hosel such that a shaft axis is offset from a hosel axis. In such a case, axial rotational shifting of the shaft assembly may result in adjustment of the face angle, lie angle, and, to some extent, the loft angle, of the golf club.

However, given that such adjustable golf clubs provide for adjustment of multiple characteristics, conveying such adjustment information to the user is often difficult. For example, the region of the club about the hosel and butt end of the shaft provides little room for providing indicia regarding the current configurations of multiple club characteristics (e.g. lie angle and face angle). Further, in some cases, manufacturers locate indicia on portion of the shaft assembly that are ultimately hidden from view during use. This limits a golfer's ability to easily recall the configuration of his or her club without disassembly. Other attempts have been made to simplify the conveyance of information regarding shaft position, but not in a manner that maintains the structural integrity of the club.

BRIEF SUMMARY OF THE INVENTION

In an embodiment, the present invention is a golf club including a striking face, a top portion, a sole portion opposite the top portion, a shaft assembly including a shaft having a butt end and a tip end, and a shaft sleeve located at the tip end, the shaft sleeve including indicia, and a hosel extending from the top portion, the hosel including a sidewall, an internal bore for receiving the shaft assembly, and an aperture extending through, and circumscribed by, the sidewall such that the indicia of the shaft sleeve corresponds with the aperture.

In another embodiment, the present invention is a golf club including a striking face, a top portion, a sole portion opposite the top portion, a shaft assembly including a shaft having a butt end and a tip end, and a shaft sleeve located at the tip end, the shaft sleeve including indicia, and a hosel extending from the top portion, the hosel comprising a hosel axis, a sidewall, an internal bore for receiving the shaft assembly, and an aperture extending through the sidewall such that the indicia of the shaft sleeve corresponds with the aperture, wherein, the aperture extends in the direction of the hosel axis by a first distance and extends circumferential to the hosel axis by a second distance that is less than the first distance.

In yet another embodiment, the present invention is a golf club including a striking face, a top portion, a sole portion opposite the top portion, a shaft assembly including a shaft having a butt end and a tip end, and a shaft sleeve located at the tip end, the shaft sleeve including indicia, a hosel extending from the top portion, the hosel comprising a hosel axis, a top section, a sidewall, an internal bore for receiving the shaft assembly, and an aperture extending through the sidewall such that the indicia of the shaft sleeve aligns with the aperture, wherein a portion of the sidewall at the top section of the hosel includes an anti-deformation structure configured to reduce deformation of the top section of the hosel, the anti-deformation structure at least partially defining the aperture, the indicia of the shaft sleeve indicates a position of the golf club when the shaft assembly is associated with the club head in an operating position by the display of the indicia through the aperture.

BRIEF DESCRIPTION OF THE DRAWINGS

The features and advantages of the present embodiments will become more apparent from the detailed description set forth below when taken in conjunction with the drawings, wherein:

FIG. 1(*a*) is a partial side view of the golf club of FIG. 1 according to an embodiment;

FIG. 23(*b*) is a perspective view of a portion of the golf club of FIG. 23(*a*) in a second position according to an embodiment; and FIG. 23(*c*) is an exploded, cross-sectional view of the golf club of FIG. 23(*a*) according to an embodiment.

DETAILED DESCRIPTION

Figure 1:
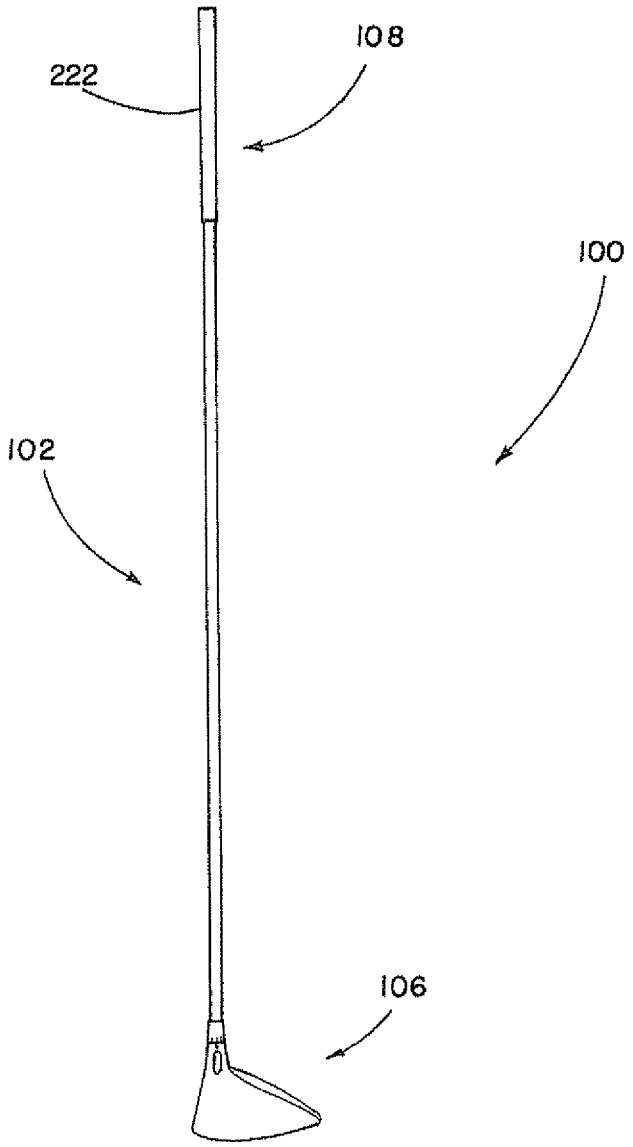
FIG. 1 is a side view of a golf club having an aperture in a hosel according to an embodiment.
Figure 1A:
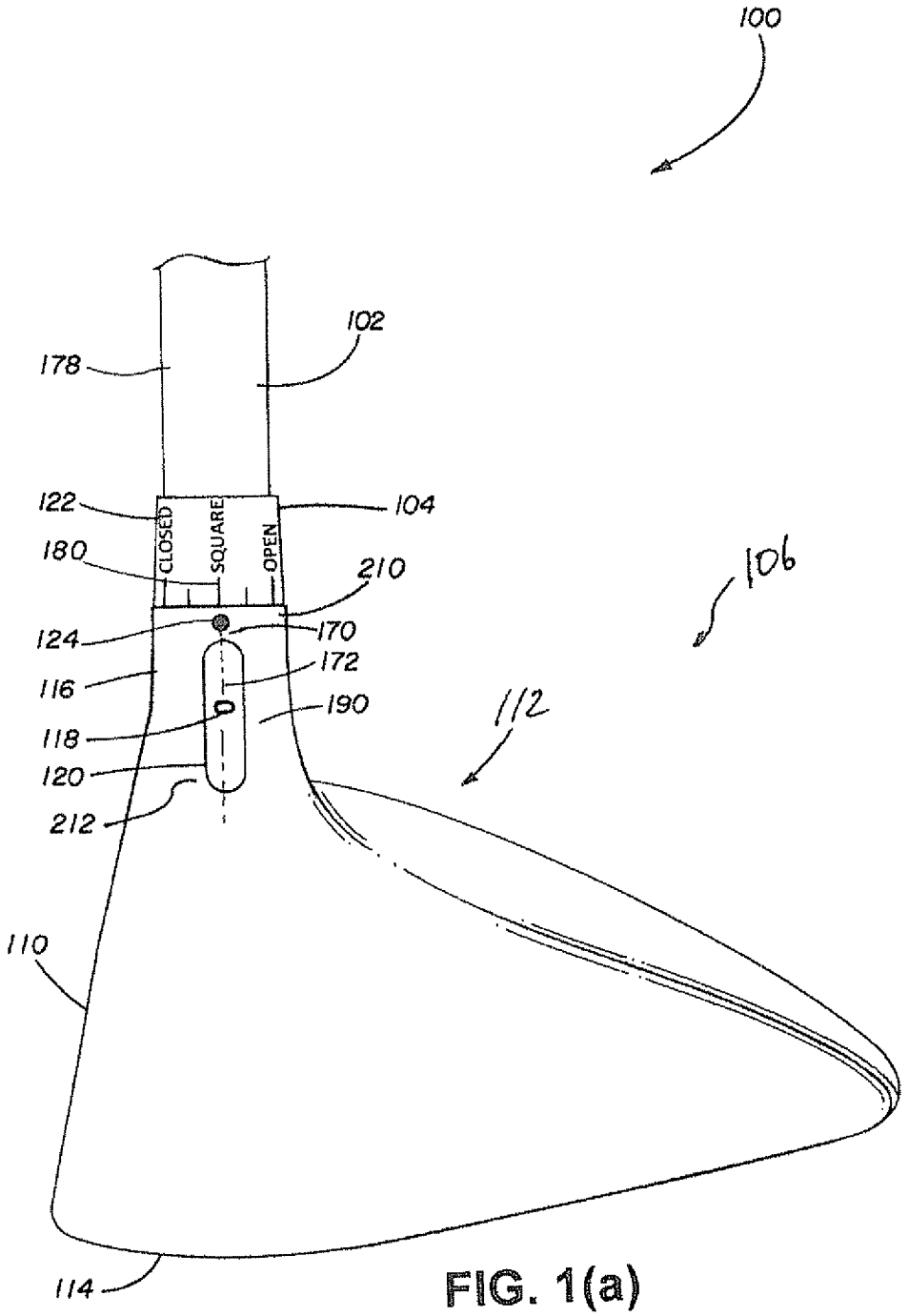
Figure 2:
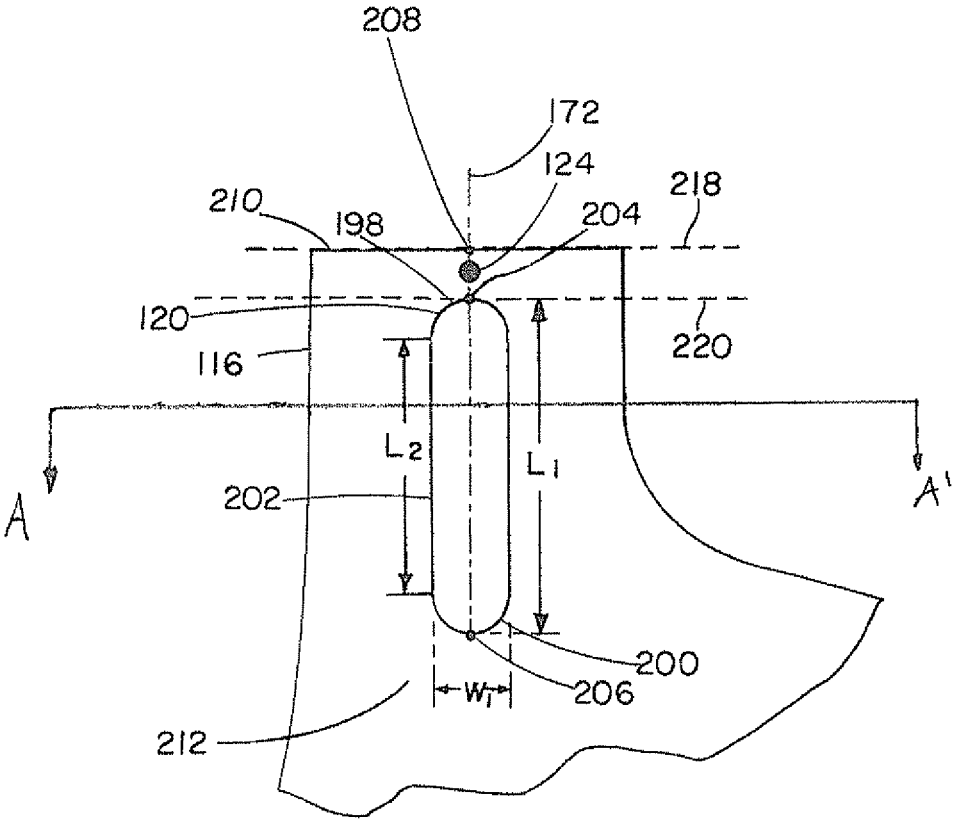
FIG. 2 is a close up view of a portion of a golf club having an aperture in a hosel according to an embodiment.
Figure 3:
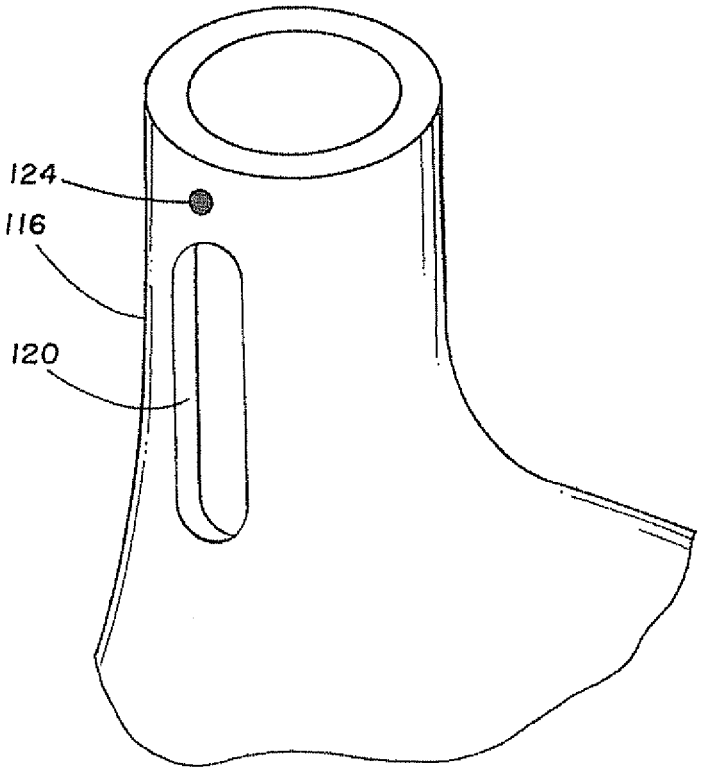
FIG. 3 is a perspective view of a portion of a golf club having an aperture in a hosel according to an embodiment.

As shown in FIGS. 1-3, in an embodiment, a golf club 100 includes, for example, a shaft assembly 102 and a golf club head 106. The golf club head 106 can include, for example, a striking face 110, a top portion 112, a sole portion 114 opposite the top portion 112, and a hosel 116 extending from the top portion 112.

The hosel 116 can include, for example, a sidewall and an internal bore for receiving the shaft assembly 102, discussed below in more detail. As shown in FIGS. 1 and 2, the hosel 116 can also include, for example, an aperture 120 extending through, and circumscribed by a sidewall 190. In an embodiment, the hosel 116 also includes an anti-deformation structure 170 at a top section of the hosel 116. The anti-deformation structure 170 at least partially defines the aperture 120. The anti-deformation structure 170 can, for example, reduce deformation of the hosel 116 due to typical strains directed at the hosel 116 when the golf club 100 is being swung, or being used to hit a golf ball. The anti-deformation structure 170 is shown as integrated with the golf club head 106, but alternatively may be a separate structure attached at the golf club head 106 proximate the top of the hosel 116.

In some embodiments, the club head 106 has a volume no less than about 360 cc, preferably no less than about 390 cc, more preferably no less than about 420 cc, and most preferable within the range of about 420 cc to about 470 cc. These ranges ensure that the club head 106 includes a moment of inertia sufficient to provide forgiveness on off-centered golf shots. In some embodiments, the club head 106 is formed of hollow-type construction, further increasing moment of inertia and, in some such embodiments, filled preferably with a material having a lower density than a material used to form a top portion, a striking face, and/or a sole portion.

In some embodiments, the club head 106 is formed of a unitary body. Alternatively, the club head 106 is formed of multiple components that are joined together by mechanical fastening, welding, brazing, chemical adhesion, and/or the like. Components of the club head 106 may be formed by casting, forging (e.g. rolling, stamping, extruding, or punching), machining (e.g. CNC milling), and/or the like, or any combination thereof.

Referring to FIG. 2, in an embodiment, the aperture 120 includes an upper portion 198 proximate a tip end 210 of the hosel 116, a lower portion 200 opposite the upper portion 198 and proximate a joint end 212 of the hosel (i.e. proximate a location where the hosel joins the top portion 112 of the golf club head 106), and a middle portion 202 between the upper portion 198 and the lower portion 200. A periphery of the aperture 120, proximate at least one of the upper portion 198 and the lower portion 200, can, for example, follow an arcuate path, while the periphery proximate the middle portion 202 extends along a generally linear path. Alternatively, in some embodiments, the periphery of the aperture 120 follows an arcuate path along its entirety, forming e.g. a circle, oval, or ellipse. In some embodiments, the upper portion 198 includes an uppermost point 204 of the aperture 120, and the lower portion 200 includes a lowermost point 206 of the aperture 120. In some embodiments, the periphery of the aperture 120 proximate the upper portion 198 (including the uppermost point 204) follows an arcuate path of a substantially constant radius, and in some cases forms a half-circle, or generally circular-shaped path. In other embodiments, the periphery of the aperture 120 proximate the lower portion 200 (including the lowermost point 206) follows an arcuate path of a substantially constant radius, and in some cases forms a half-circle, or generally circular-shaped path. Configuring the aperture 120 in such a manner reduces stress concentrations typically associated with sharp corners, particularly as the hosel, during use, experiences tensile, bending, and torsional stresses.

Furthermore, as shown in FIGS. 1-3, the hosel 116 includes indicia (e.g., an alignment indicator 124). The alignment indicator 124 may be formed by an organic coating (e.g. paint), chemical- or laser-etching, stamping, punching, drilling, or milling. The alignment indicator 124 can be used, for example, to indicate an orientation of the striking face 110 with respect to certain parts or portions of the shaft assembly 102, as discussed in more detail below.

Referring again to FIG. 2, in an embodiment, the hosel 116 can include a hosel axis 172. The aperture 120 can, for example, be elongated in a direction along the hosel axis 172. In an embodiment, the aperture 120 has a maximum width $W_1$ no greater than 8 millimeters (mm), more preferably within the range of 2 mm to 6 mm, and most preferable substantially equal to 3 mm. In an embodiment, the aperture 120 has an average width $W_1$ no greater than 8 mm, more preferably within the range of 2 mm to 6 mm, and most preferable substantially equal to 3 mm. In an embodiment, the aperture 120 has a maximum length $L_1$ no greater than 22 mm, more preferably within the range of 4 mm to 22 mm, even more preferably within the range of 12 mm to 20 mm. In an embodiment, the aperture 120 has an average length no greater than 22 mm, more preferably within the range of 8 mm to 22 mm, even more preferably within the range of 12 mm to 20 mm.

In an embodiment, the aperture 120 has a width $W_1$ of approximately 3 mm, and a maximum length $L_1$ of approximately 16 mm. In some embodiments, for example as shown in FIG. 2, the aperture 120 includes a middle portion 202 defined by the portion of the aperture 120 bounded by the portion of the periphery that generally follows a linear path. A length, $L_2$, corresponds to the length of the middle portion 202 of the aperture 120. $L_2$ can, for example, be between approximately 13 mm and 14 mm. These ranges ensure that the aperture 120 is sufficiently large to display necessary indicia therethrough, however so dimensioned as to not appreciably degrade the structural integrity of the club head 106.

In some embodiments, a ratio $L_1/L_2$ is preferably within the range of 0.28 and 1.70, more preferably within the range of 0.57 and 1.53, and most preferably equal to about 1.23. Alternatively, or in addition, the aperture 120 includes a ratio $W_1/L_1$ that is preferably within the range of 0.09 and 2, more preferably within the range of 0.15 and 0.50, and most preferably equal to about 0.19. These ranges ensure that the visibility of indicia shown through the aperture 120 is maximized, while degradation of the structural integrity of the golf club 106 is minimized.

Referring again to FIG. 2, in an embodiment, an uppermost point 208 of the hosel 116 (i.e., the point closest to the tip end 210 of the hosel 116 measured in a direction along the hosel axis 172) is located on a first imaginary plane 218 perpendicular to the hosel axis 172. In addition, the aperture 120 includes an uppermost point 204 (measured in a direction along the hosel axis 172) located on a second imaginary plane 220 that is parallel to the first imaginary plane 218. The first imaginary plane 218 is preferably separated from the second plane 220 by at least 0.5 mm, and more preferably by at least 1.0 mm. This can, for example, reduce the likelihood of deformation of the hosel 116 caused by the presence of the aperture 120.

Figure 4:
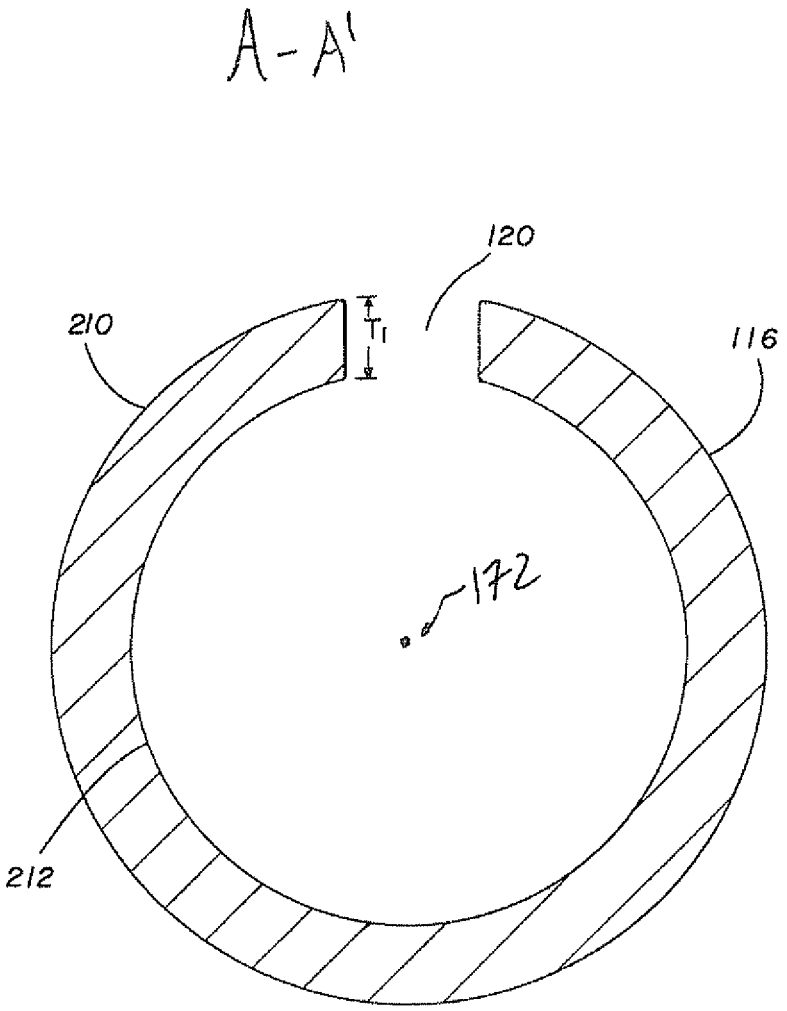
FIG. 4 is a cross-sectional view of a portion of a golf club having an aperture in a hosel according to an embodiment.

Referring to FIG. 4, the aperture 120 also has a maximum thickness, $T_1$, preferably no greater than approximately 2.5 mm. In an embodiment, the aperture 120 also has an average thickness (i.e., the average of all thicknesses measured about the periphery of the aperture) no greater than approximately 2.5 mm.

Figure 5:
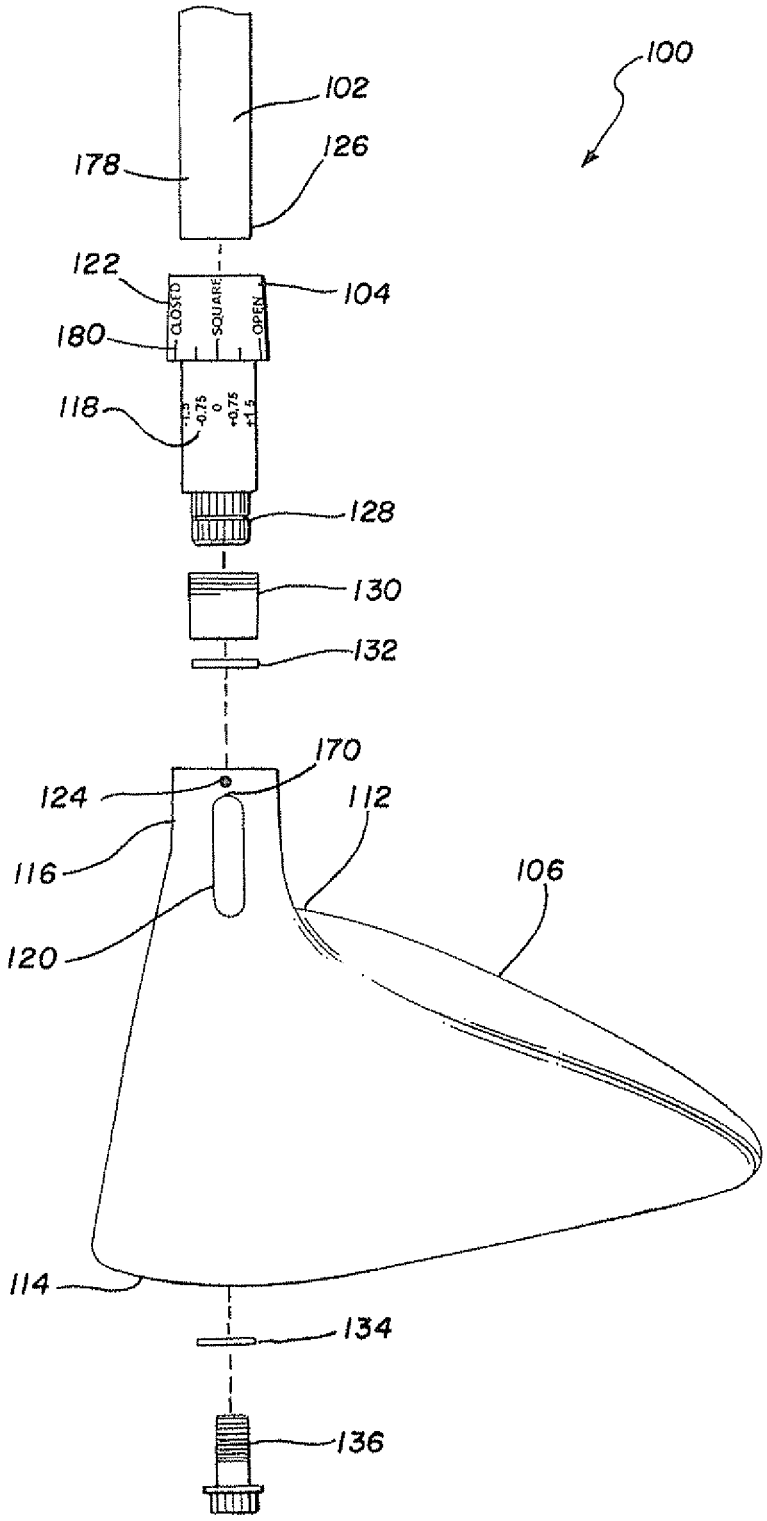
FIG. 5 is an exploded side view of a golf club having an aperture in a hosel according to an embodiment.
Figure 6:
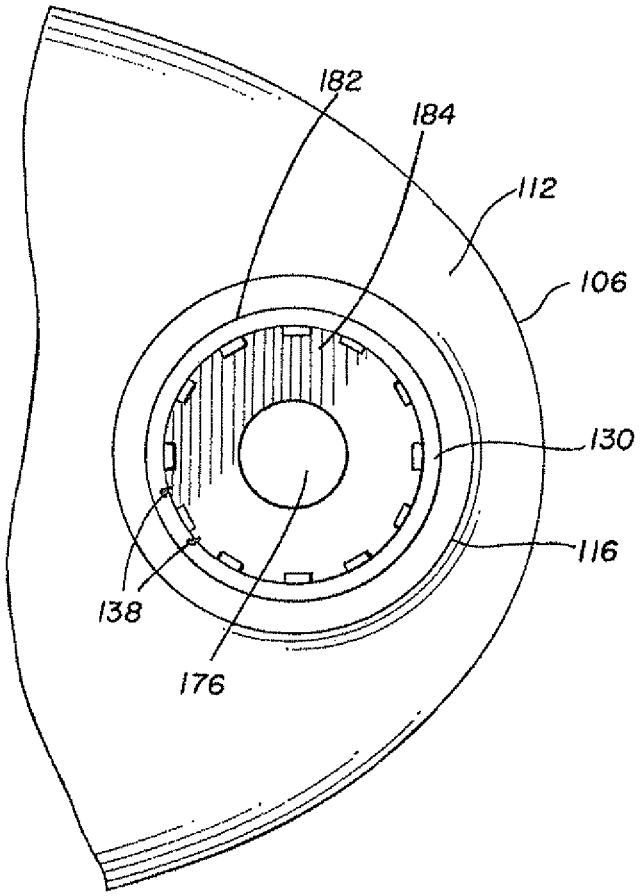
FIG. 6 is a top view of a hosel according to an embodiment.

As shown in FIGS. 5 and 6, the hosel 116 can include inserts 130 and 132, which are configured to be fixedly associated with the hosel 116, within the hosel bore 184. The hosel 116 also includes a throughbore 176 for accepting a securing member such as a screw 136. The throughbore 176, in some embodiments, is in communication with a bottom surface of the sole portion 14 of the club head 106 and in communication with the hosel bore 184. A spring washer 134 can be placed between the screw 136 and the hosel 116 to ensure a tighter fit, particular in consideration of vibrations that may emanate as result of impact between the club head 106 and a golf ball. The spring washer 134 and the screw 136 can be used to secure the shaft assembly 102 to the hosel 116, for example, by association within an internal threaded bore extending upward from a butt end of a shaft sleeve 104 of the shaft assembly 102.

As shown in FIG. 6, the insert 130 can be placed in the bore 184 of the hosel 116. In an embodiment, the insert 130 includes a rotation inhibiting element 138 to prevent rotation of the shaft assembly 102. The rotation inhibiting element 138 can include, for example, a plurality of grooves elongated in the axial direction. In an embodiment, the rotation inhibiting element 138 includes a plurality of fluted elements that generally extend in the axial direction and are radially spaced from each other, optionally at uniform increments. In any of these embodiments, preferably the shaft sleeve 104 comprises an external surface that is complementary to the surface formed by the rotation inhibiting element 138, as discussed further below.

Referring to FIGS. 1, 1(*a*), and 5, the shaft assembly 102 can include, for example, a shaft 178 including a butt end 108 and a tip end 126. In an embodiment, the butt end 108 can include, for example, a grip 222.

Figure 7:
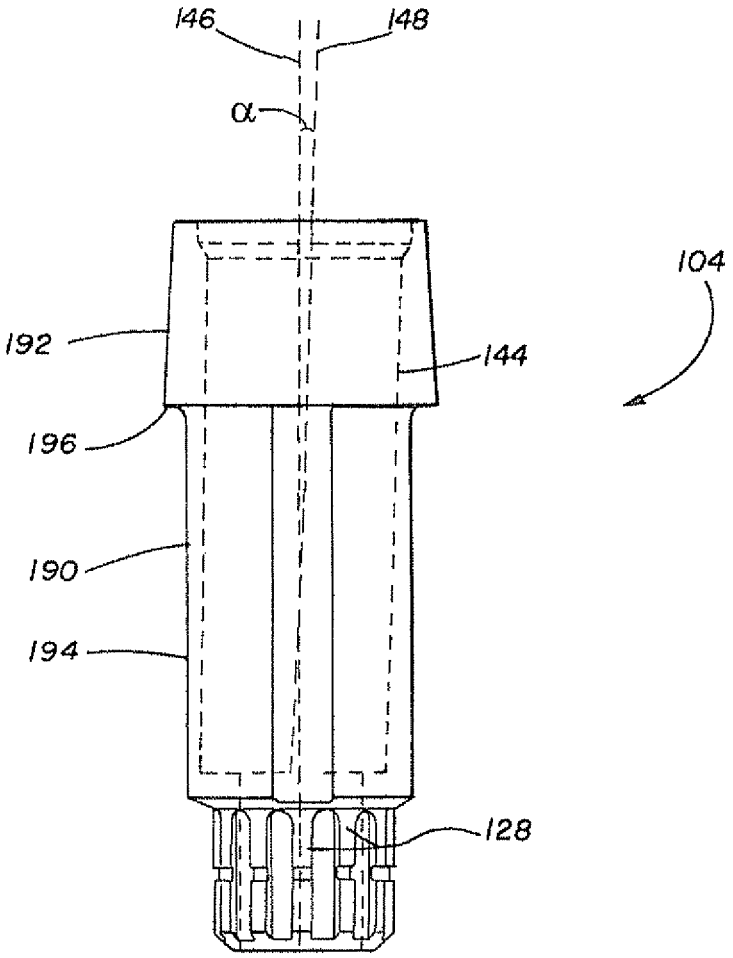
FIG. 7 is a side view of a shaft sleeve according to an embodiment.

In an embodiment, the shaft assembly 102 includes a shaft sleeve 104 located proximate the tip end 126 of the shaft 178. As seen in FIG. 7, the shaft sleeve 104 includes a bore 144. The bore 144 can, for example, extend in a direction offset from the direction of extension of the portion of the shaft sleeve 104 that engages with the hosel 116 (e.g., an outer surface 182 angularly offset from the hosel axis 172). Accordingly, the outer surface 182 of the shaft sleeve 104 forms a generally cylindrical shape about an imaginary center line 146 (collinear with the hosel axis 172), while the bore 144 forms a generally cylindrical shape about a center line 148 that is differently oriented than the center line 146. The angle $\alpha$ corresponds to a maximum offset angle formed between the center line 146 and the center line 148. The bore 144 can be configured to receive the tip end 126 of the shaft 178.

Referring again to FIGS. 5 and 7, the shaft sleeve 104 also includes a rotation inhibiting element 128 to prevent rotation of the shaft assembly 102. The rotation inhibiting element 128 includes a plurality of grooves elongated in a direction parallel to the center line 146. For example, the rotation inhibiting element 128 can be a plurality of elongated projections.

The shaft sleeve 104 is adapted to be placed within the bore 184 of the hosel 116. The rotation inhibiting elements 128 and 138 are complementary to each other in geometry and, thus, adapted to cooperate to prevent rotation of the shaft sleeve 104, the shaft 178, and/or the shaft assembly 102, when the golf club impacts a golf ball in use. Furthermore, a securing member (e.g., the screw 136), can extend through the hosel 116, and portions of the shaft sleeve 104 to mate with the shaft 178, thereby securing the shaft 178 to the hosel 116. Specifically, in some embodiments, the shaft sleeve 104 further includes a threaded inner bore for receiving the securing member 136.

In alternative embodiments, the securing member comprises an annulus that encircles the shaft assembly 102 and includes a threaded internal portion configured to mate with a threaded portion of the outer surface of the hosel 116.

Due to the offset bore 144, the shaft 178 is oriented at an angle within the shaft sleeve 104 relative to a hosel axis. Thus, different rotational positions of the shaft sleeve 104 in the hosel 116 will result in various orientations of the striking face 110 with respect to the shaft 178.

Figure 8:
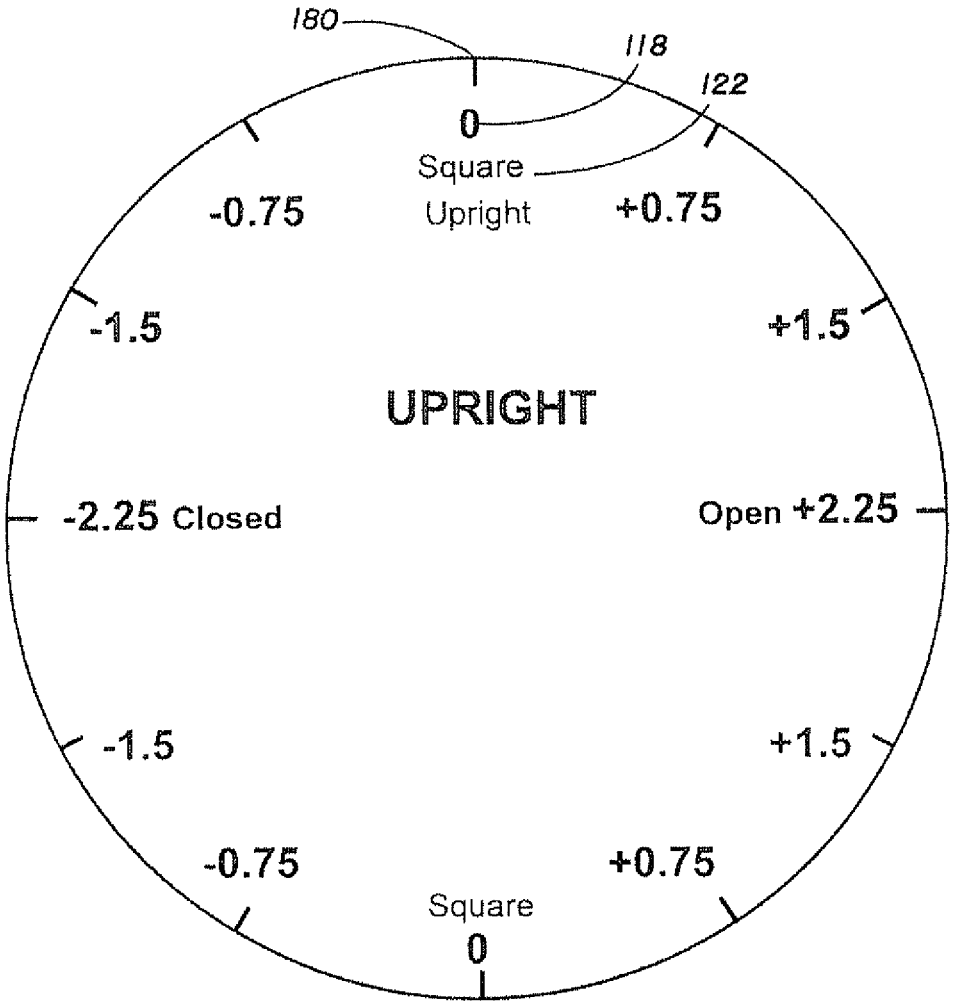
FIG. 8 is a chart depicting various indicia on a shaft sleeve according to an embodiment.

As shown in FIG. 5, the shaft sleeve 104 includes indicia 122 and indicia 118. The indicia 122 and the indicia 118 generally indicate a position of the golf club 100 when the shaft assembly 102 is associated with the golf club head 106 in an operating position. For example, the indicia 122 and the indicia 118 can indicate the orientation of the striking face 110 with respect to the shaft 178. Preferably, in a guide shown in FIG. 8, the indicia 118 and the corresponding indicia 122 according to an embodiment are shown. In an embodiment, alternative indicia 118 and 122 can also be used.

Figure 9:
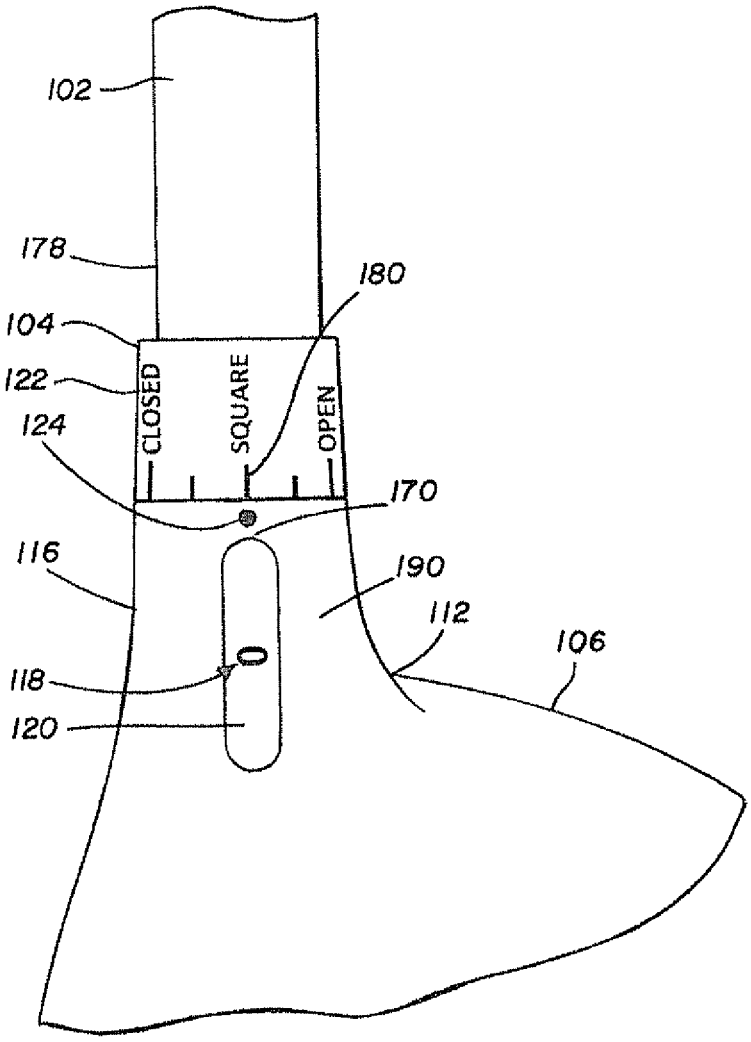
FIG. 9 is a partial side view of a golf club having an aperture in a hosel according to an embodiment.

Referring to FIG. 9, in an embodiment, the indicia 118 corresponds with the aperture 120. As shown, the indicia 118 is aligned axially with the aperture 120 and is visible through the aperture 120. Alternatively, the indicia 118 may be aligned radially with the aperture 120.

In some embodiments, the indicia 118 and the indicia 122 each indicate a characteristic of the golf club. In such embodiments, the indicia 118 corresponds to a face angle of the club head (i.e., the degree of rotation of the striking face about a vertical axis when the club head is oriented in a reference position relative to a squared position). Additionally, the indicia 118 preferably corresponds to the lie angle of the club head or, more preferably, the change in lie angle of the club head relative to a base, or factory-designated, lie angle. For example, regarding the first set of indicia 118, "0" corresponds to a position of the golf club 100 in which the club head includes a face angle corresponding to the factory-designated face angle. Negative increments of "−0.75" and "−1.5" each correspond to a decrease in degree of face angle from the factory-designated face angle according to the number shown. Positive increments of "+0.75" and "+1.5" each correspond to an increase in degree of face angle from the factory-designated face angle according to the number shown.

In some embodiments, the indicia 122 pertain to a qualitative indication of the face angle of the golf club when positioned to address a golf ball. "SQUARE" corresponds to a position of the golf club in which the face angle is squared with the golf ball, (i.e., unmodified from a default position). "CLOSED" corresponds to a position of the golf club in which the face of the golf club is rotated in the positive forward direction, which may be beneficial to the golfer to correct a slice. "OPEN" corresponds to a position of the golf club in which the golf club is rotated in the positive rearward direction, which may be beneficial to the golfer to correct a hook. "UPRIGHT" indicates a position of the golf club in which lie angle is increased from a factory-designated lie angle, which may be beneficial to golfers who are shorter than average in height.

Thus, information pertaining to characteristics of the orientation of the club head may be expressed in absolute terms, or in relative terms. Additionally, such characteristics may be expressed either quantitatively (e.g., by using indicia corresponding to an angular measurement or difference in angular measurements), or qualitatively. In such cases, the indicia 122 can provide information related to the indicia 118 such as whether the orientation is open, square, closed, or square upright. To indicate which of indicia 118 and 122 correspond to the orientation of the club, the indicia 122 can include, for example, an alignment indicator 180 with a series of tick marks each correlated with a face angle value. The alignment indicator 180 can be aligned with the alignment indicator 124 (FIG. 1) of the hosel 116 to indicate which designations of each of indicia 118 and 122 govern the orientation of the club.

For example, in FIG. 9, the golf club 100 is shown in a first position. In this position, the indicia 118 includes a displayed designation of "0" that is visible through the aperture 120. This indicates that the club, in this position, has a change in lie angle from its standard position of 0 degrees (i.e., the lie angle of the golf club corresponds to its factory-designated lie angle). The indicia 122 includes a displayed designation of "SQUARE" that is aligned with the indicator 124. This indicates that the club, in this position, has a face angle that is neither open nor closed, but "square" with the anticipated line of impact with a golf ball. In contrast, in FIG. 10, after removal, rotation and reinsertion, the shaft sleeve 104 is associated with the hosel 116 in a second position that is different from the position shown in FIG. 9. In this position, the indicia 118 includes a displayed designation of "−2.25" that is visible through the aperture 120. This indicates that the club, in this position, has a change in face angle from its standard position of 2.25 degrees. The indicia 122 includes a displayed designation of "closed" that is aligned with the indicator 124. This indicates that the club, in this position, has a face angle that is "closed."

Figure 11:
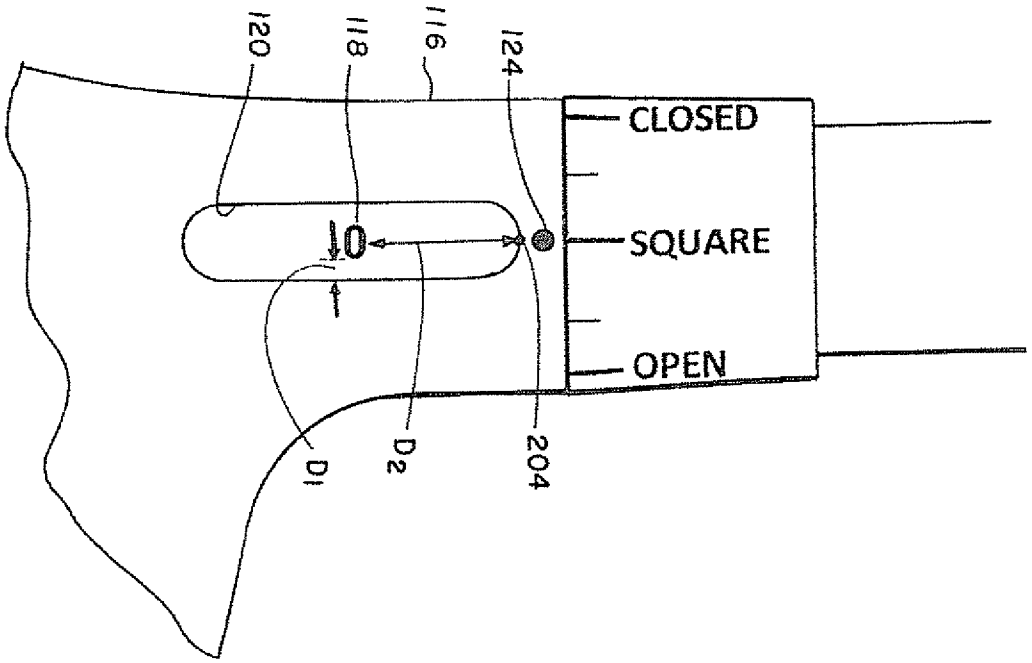
FIG. 11 is a partial side view of a golf club having an aperture in a hosel according to an embodiment.
Figure 12A:
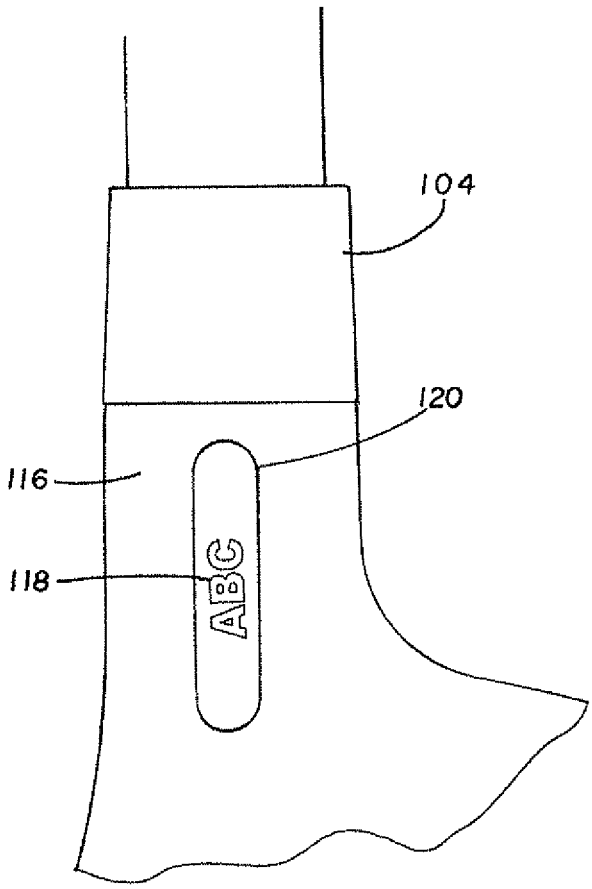
FIGS. 12(*a*)-12(*i*) depict partial side views of alternate hosel, shaft sleeve, and aperture embodiments.
Figure 12B:
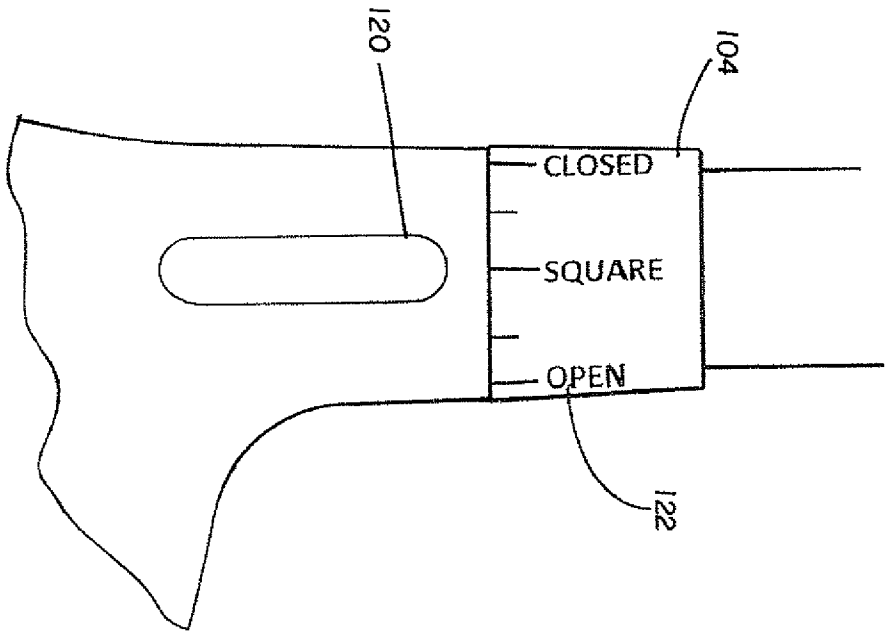
Figure 12C:
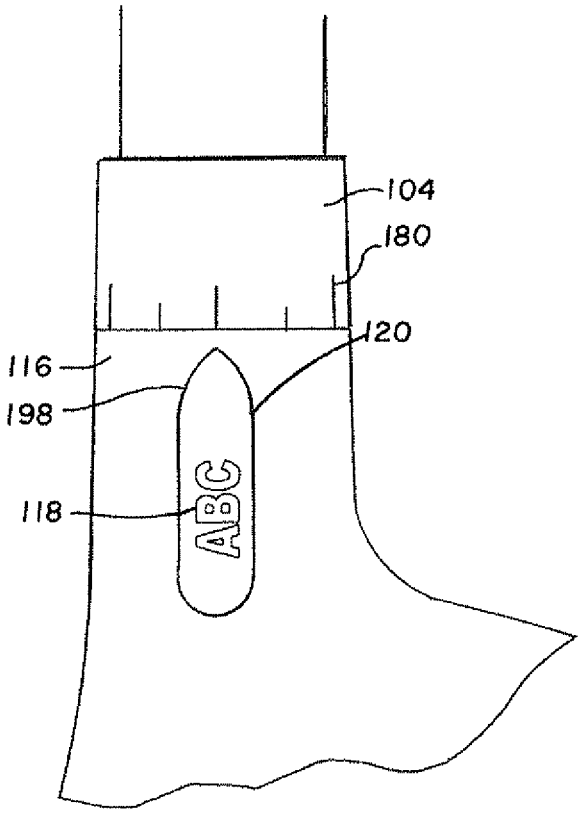
Figure 12D:
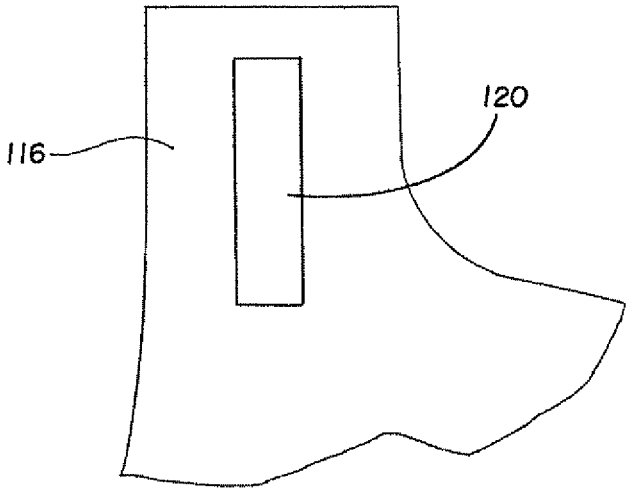
Figure 12E:
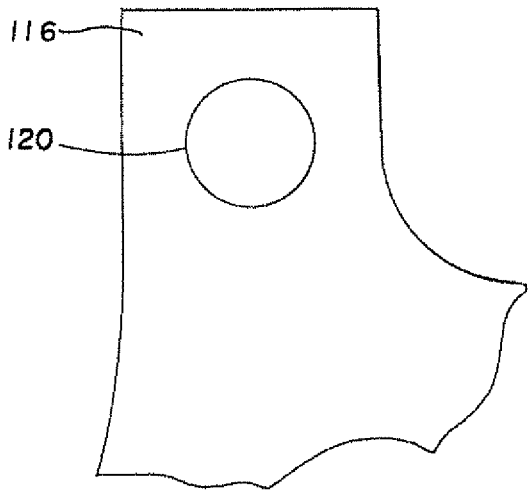
Figure 12F:
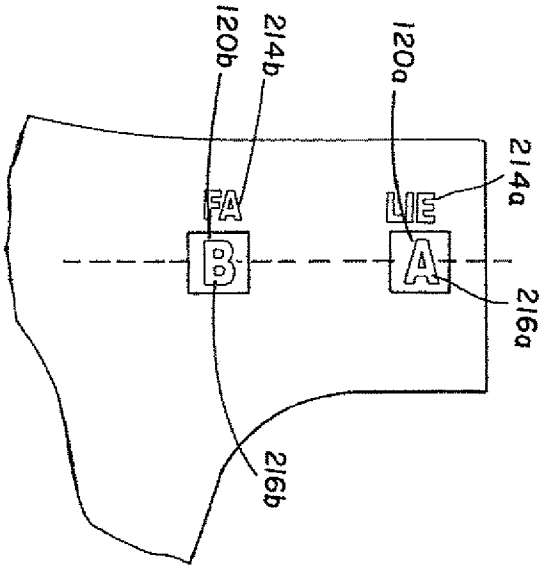
Figure 12G:
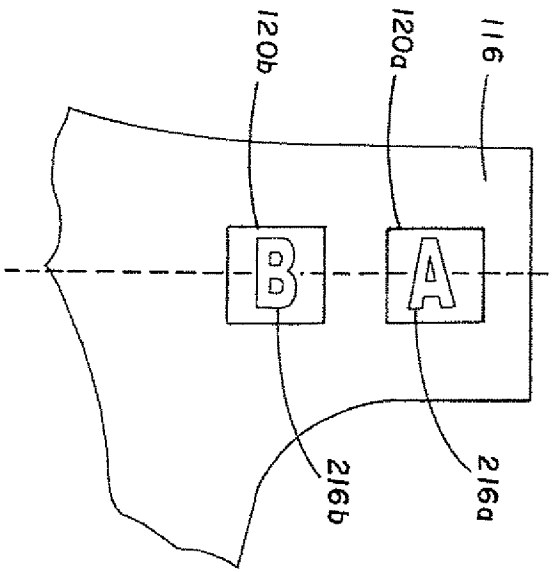
Figure 12H:
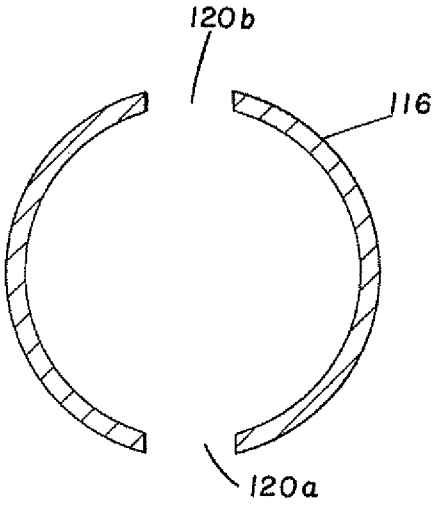
Figure 12I:
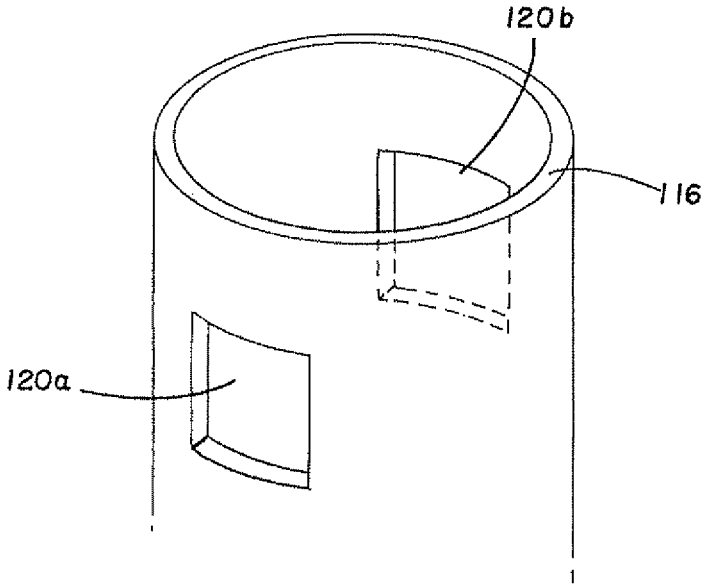

In an embodiment, as seen in FIG. 11, the aperture 120 and the indicia 118 are so dimensioned to optimize visibility, yet avoid appreciable degradation of the structural integrity of the hosel 116. For example, the indicia 118 and the hosel window (e.g., the aperture 120) are adapted such that, when in an operating position, a visible designation included in the indicia 118 is spaced a minimum distance $D_1$ from an edge of the aperture 120. In an embodiment, the distance $D_1$ can be sufficiently large such that the indicia 118 is legible and visible from a wide range of vantage points. Also, preferably, $D_1$ is no less than 0.53 mm, and more preferably within the range of 0.53 mm to 0.57 mm. Furthermore, the indicia 118 can be spaced a minimum distance $D_2$ from of the uppermost point 204 of the aperture 120 or the lowermost point 206 of the aperture 120. Preferably, $D_2$ is no less than 1.86 mm, more preferably no greater than 7.24 mm, and even more preferably, within the range of 1.86 mm and 4.63 mm. In an embodiment, the distance between the indicia 118 and the uppermost point 204 of the aperture 120 and the distance between the indicia 118 and the lowermost portion 206 of the aperture 120 need not be the same. Also, preferably, $D_1$ is not equal to, and more preferably less than, $D_2$.

In alternative embodiments, the golf club 100 of FIG. 11 may be formed without the indicia 124 located on the outer surface of the hosel. In this case, the aperture 120 itself may serve dual purposes as both an indicator of a quantitative expression of a characteristic of a position of the golf club (by selectively allowing the display of an indicium through the aperture 120 from amongst plural indicium constituted by indicia 118) and also as an indicator of a qualitative expression of a characteristic of a position of the golf club (by the axial alignment of the aperture 120 with the indicia 122).

Figure 10:
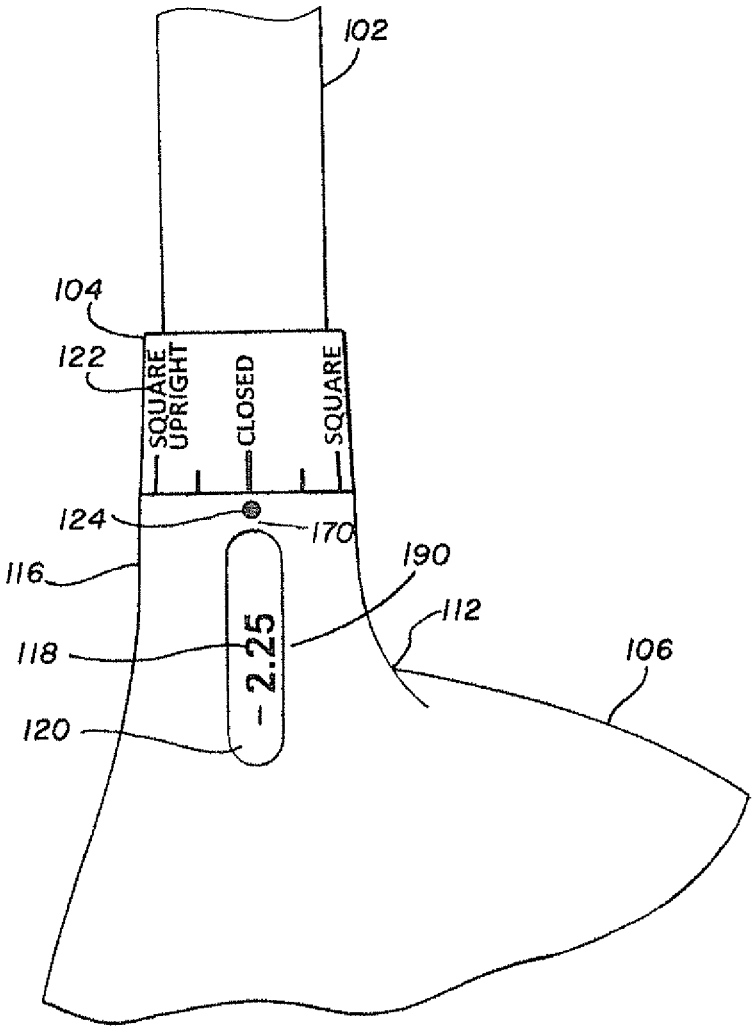
FIG. 10 is a partial side view of a golf club having an aperture in a hosel according to an embodiment.

In an embodiment, as shown in FIG. 10, the aperture 120 may include a filleted (or rounded) rectangular shape. Alternatively, the aperture 120 could be formed in other geometric shapes such as a rectangle, an ellipse or a triangle, or a non-geometric shape which can properly display an indicia. However, the aperture 120 preferably forms a shape having generally rounded corners to minimizing the extent of high stress regions, due to large stresses incurred by the hosel region during a typical impact between the golf club and a golf ball.

In FIG. 12(*a*), the aperture 120 displays the indicia 118. However, the hosel 116 is depicted without the alignment indicator 124 (as in the embodiments shown in FIG. 11), and the shaft sleeve 104 is depicted without the indicia 122 (as in the embodiments shown in FIG. 11). In this case, the indicia 118 may be solely relied on as indicating to the user all necessary information regarding the position of the golf club. In FIG. 12(*b*), the shaft sleeve 104 is depicted without the indicia 118 (as in either of the embodiments shown in FIGS. 11 and 12(*a*)), and the hosel 116 is depicted without the alignment indicator 124 (as in the embodiment shown in FIG. 11). In FIG. 12(*c*), the hosel 116 is depicted without the alignment indicator 124 (as in the embodiment shown in FIG. 11), and the shaft sleeve 104 is depicted without the indicia 122 (as in the embodiment shown in FIG. 11). In alternative embodiments, indicia similar to the indicia 122 of the embodiment shown in FIG. 12(*b*) is included in the embodiment shown in FIG. 12(*c*). In addition, the aperture 120 is shaped such that the upper portion 198 forms a pointer which aims at a corresponding alignment indicator 180.

In FIG. 12(*d*), the aperture 120 has a rectangular shape. In FIG. 12(*e*), the aperture 120 has a circular shape. In FIG. 12(*f*), the hosel 116 includes a plurality of apertures 120*a* and 120*b*. The hosel 116 also includes indicia 214*a* and 214*b*. The indicia 214*a* indicates that the indicia 216*a* depicted in the aperture 120*a* corresponds to lie angle of the golf club head 106. The indicia 214*b* indicate that the indicia 216*b* depicted in the aperture 120*b* correspond to the face angle of the golf club head 106. In FIG. 12(*g*), the hosel 116 does not include the indicia 214*a* and 214*b*. Instead, only the indicia 216*a* and 216*b* (associated with a shaft sleeve positioned within the hosel) are included.

In FIGS. 12(*h*) and 12(*i*), apertures 120*a* and 120*b* are diametrically opposed to each other on the hosel 116 (with respect to a hosel central axis). Although not shown, in other embodiments, the apertures 120*a* and 120*b* can also display the indicia 216*a* and 216*b*. As shown, the apertures 120*a* and 120*b* are generally located at the same height relative to the hosel axis. However, in alternative embodiments, the apertures 120*a* and 120*b* are located at different heights with respect to the hosel axis 172 of the hosel 116. The apertures 120*a* and 120*b* can also be located at other locations on the hosel 116 and need not face each other directly.

Figure 13:
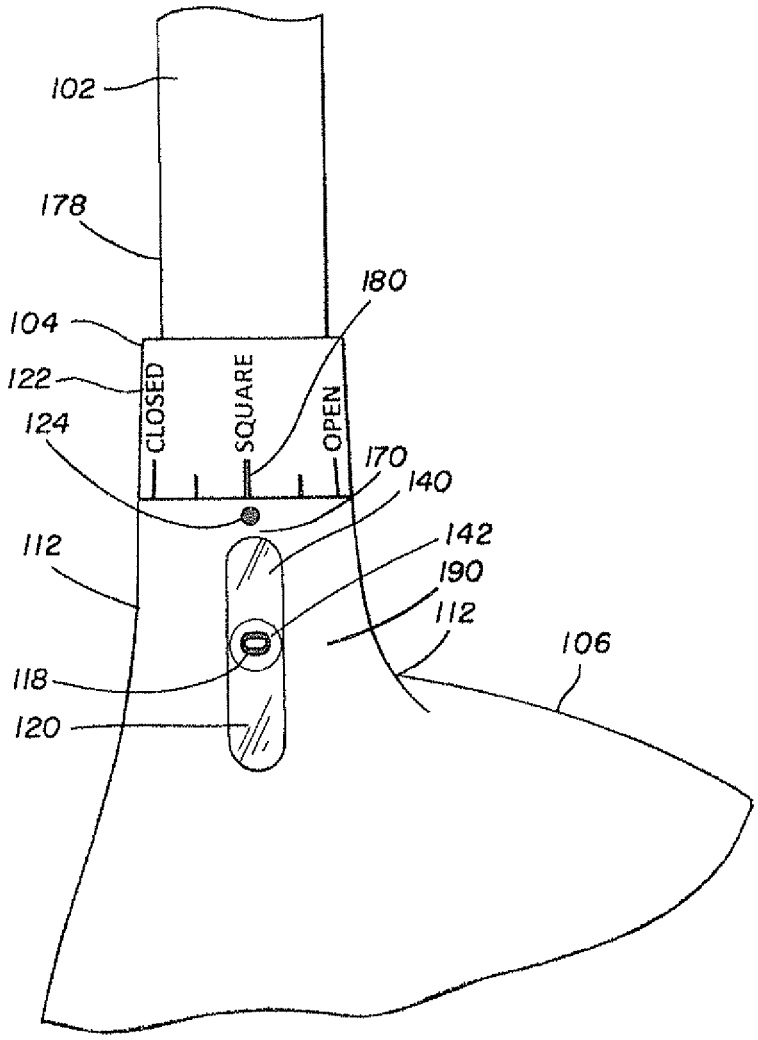
FIG. 13 is a partial side view of a golf club having an aperture in a hosel that includes a cover element according to an embodiment.

Optionally, as seen in FIG. 13, the aperture 120 can be covered, filled or partially filled by a covering element 140. The covering element 140 can be, for example, a non-metallic material and/or a translucent material such as polyurethane or polycarbonate materials. In some embodiments, the covering elements 140 is transparent (e.g., with or without tint). By utilizing the covering element 140, the indicia 118 may be protected from dust or debris (e.g., sand, dirt, etc.) when the golfer plays a round of golf with the club. This can prevent degradation of the indicia and prolong the life of the golf club 100.

Furthermore, the covering element 140 can optionally include a magnifying element 142 to magnify the indicia 118. The magnifying element can be formed from a translucent material, such as polyurethane or polycarbonate materials. By magnifying the element 142, the indicia 118 can be easier to read without requiring the indicia 118 to be extremely large. This can, for example, enable a reduced size of the aperture 120, further improving the structural integrity of the hosel 116. Furthermore, the magnifying element 142 can aid in allowing the indicia 118 to be easily read by a variety of users, especially users with vision problems. In one embodiment, applying a magnifying element 142 may be very desirable for golf clubs with high flex (e.g., clubs with A-flex shafts) which are geared towards usage by older individuals who are more likely to benefit from magnified indicia 118.

Figure 14:
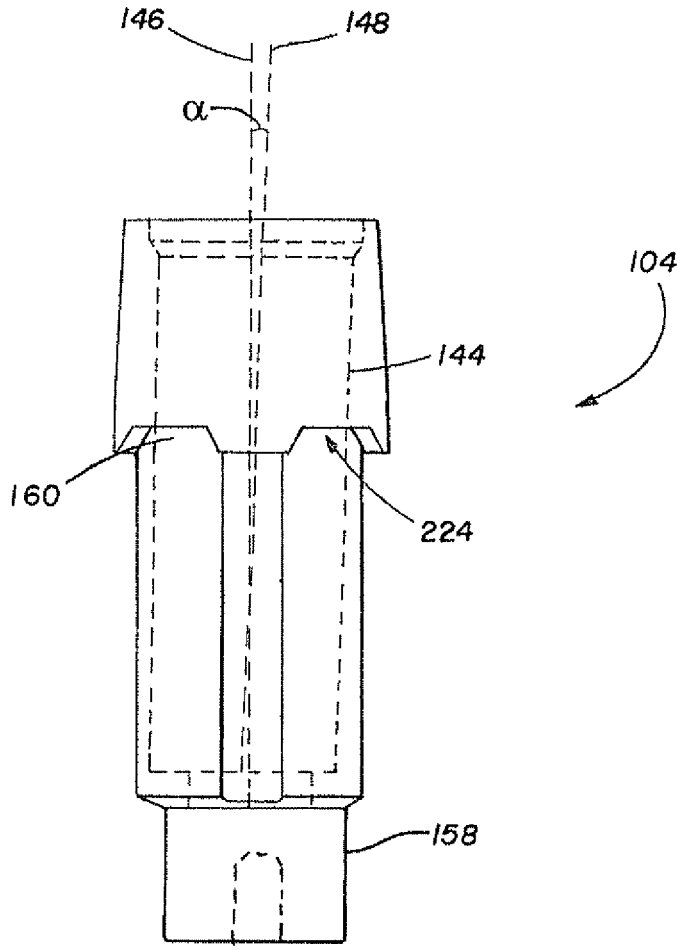
FIG. 14 is a side view of a shaft sleeve according to an embodiment.

In an embodiment, as shown in FIG. 14, a shaft sleeve 104 terminates in an end 158. As can be seen, the end 158 is substantially smooth. As shown in FIG. 14, the rotation inhibiting element 160 includes a plurality of notches 224 that extend upward from a portion of the shaft sleeve 104, the notches 224 delimiting a plurality of prongs that extend downward from a portion of the shaft sleeve 104. For example, the rotation inhibiting element 160 can constitute a castellated structure. In some embodiments, the notches 224 each taper in width in the upward direction (i.e., toward the butt end 108 of the shaft). Preferably, a portion of the hosel 116 includes complementary geometry for securely receiving the shaft sleeve 104. Having the plurality of notches taper in width in the upward direction enables a complementary fit between the shaft sleeve 104 and the hosel 116, despite any small variations in dimensions due to manufacturing tolerances.

Figure 15:
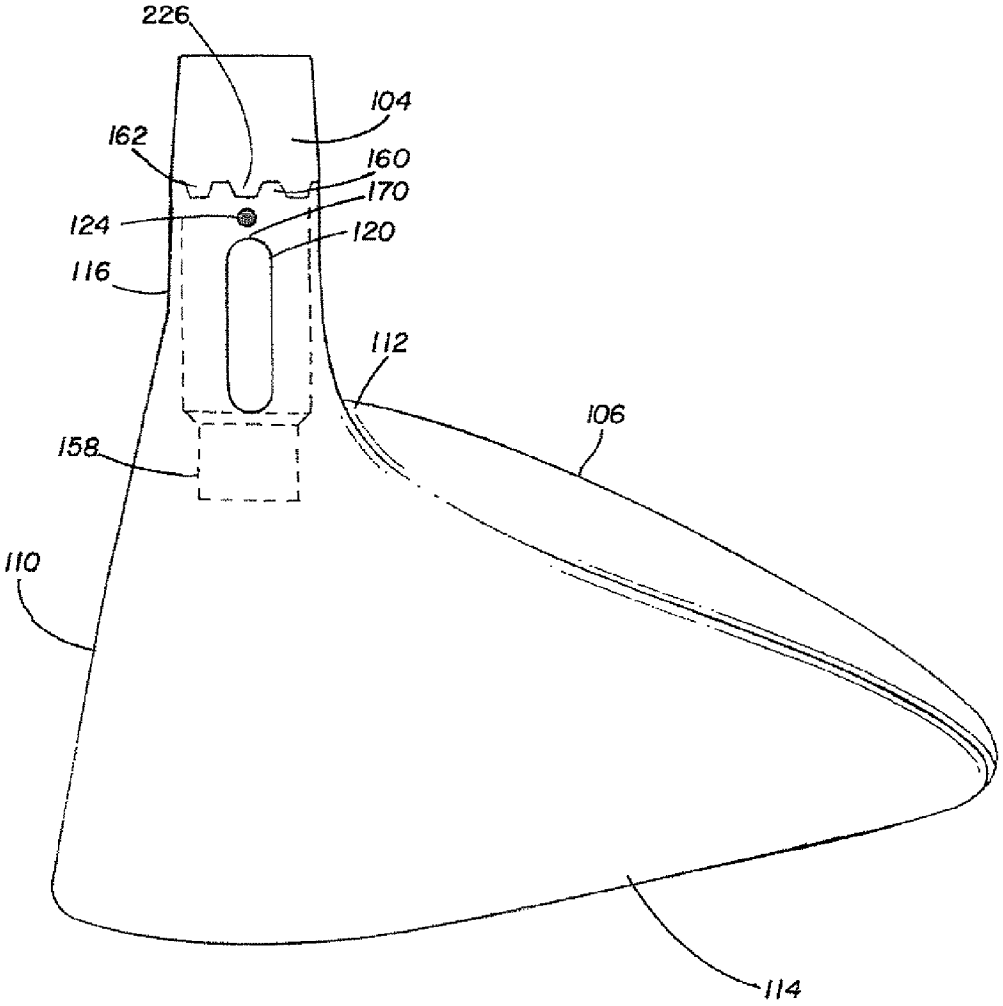
FIG. 15 is a partial side view of a golf club having an aperture in a hosel according to an embodiment.
Figure 16A:
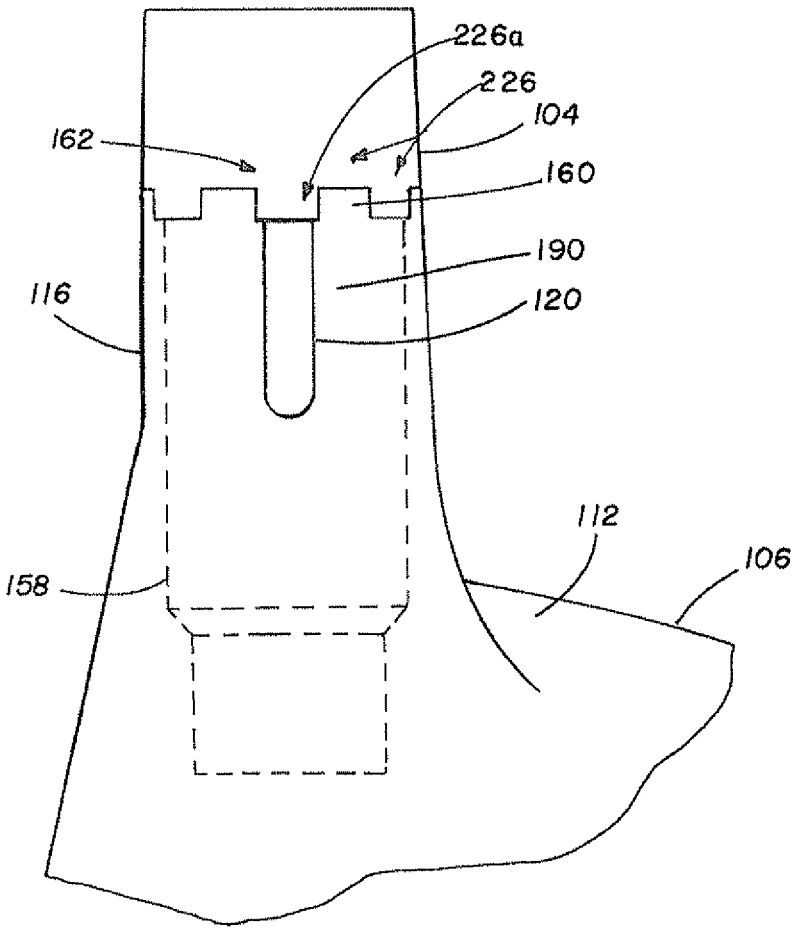
FIG. 16(*a*)-16(*e*) depict partial side views of alternate hosel, shaft sleeve, and aperture embodiments.
Figure 16B:
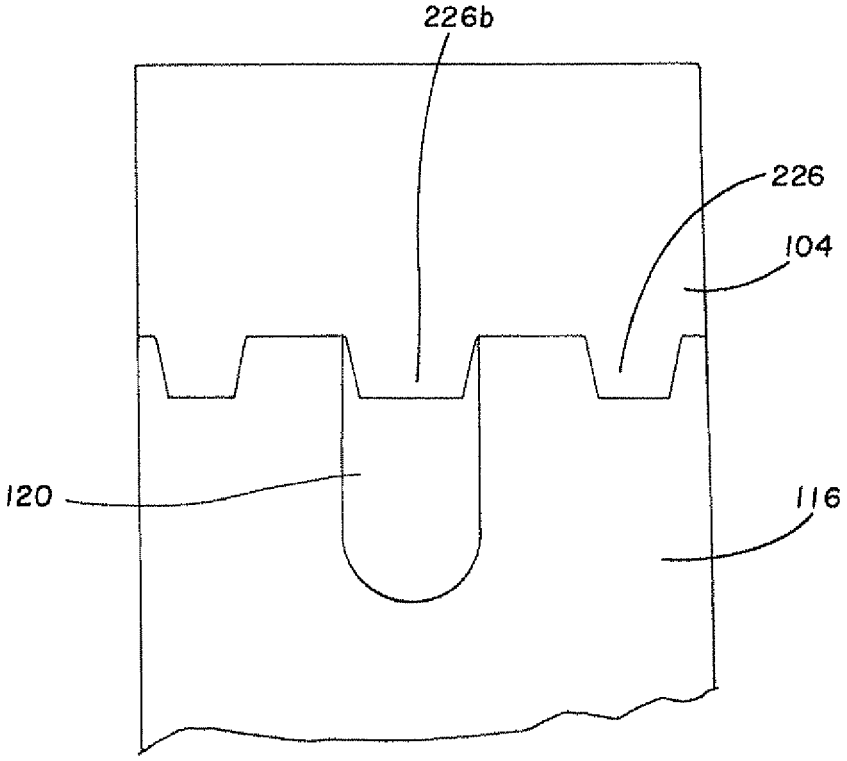
Figure 16C:
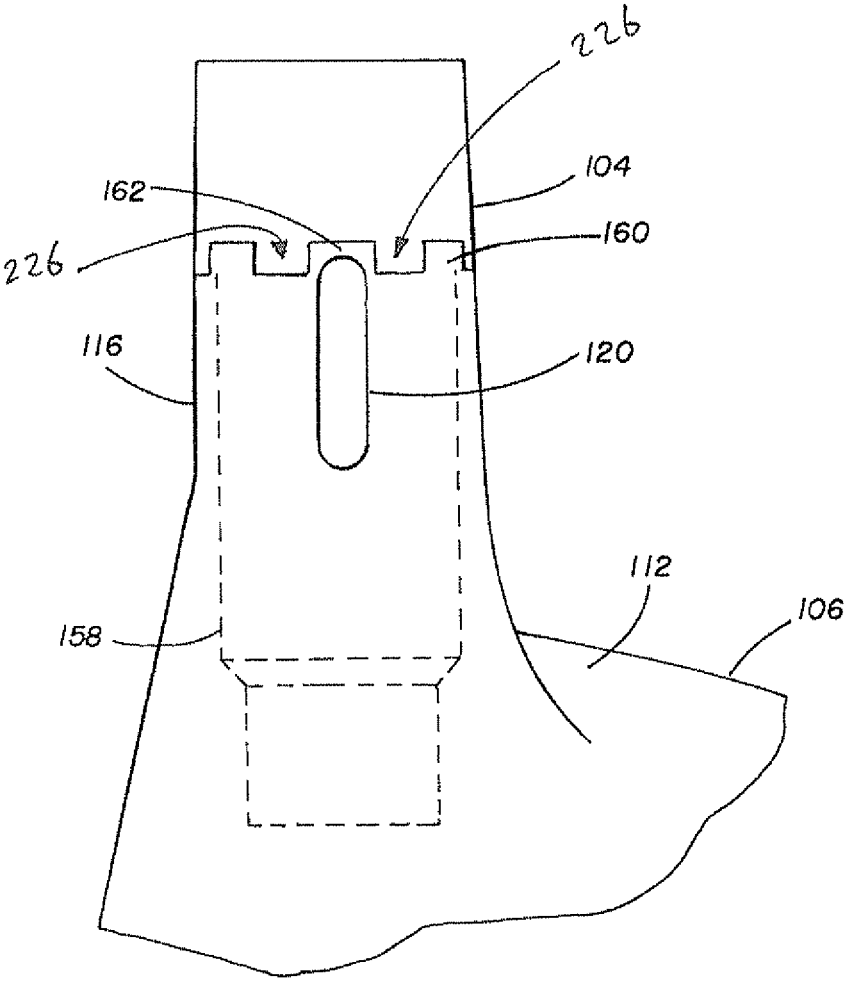
Figure 16D:
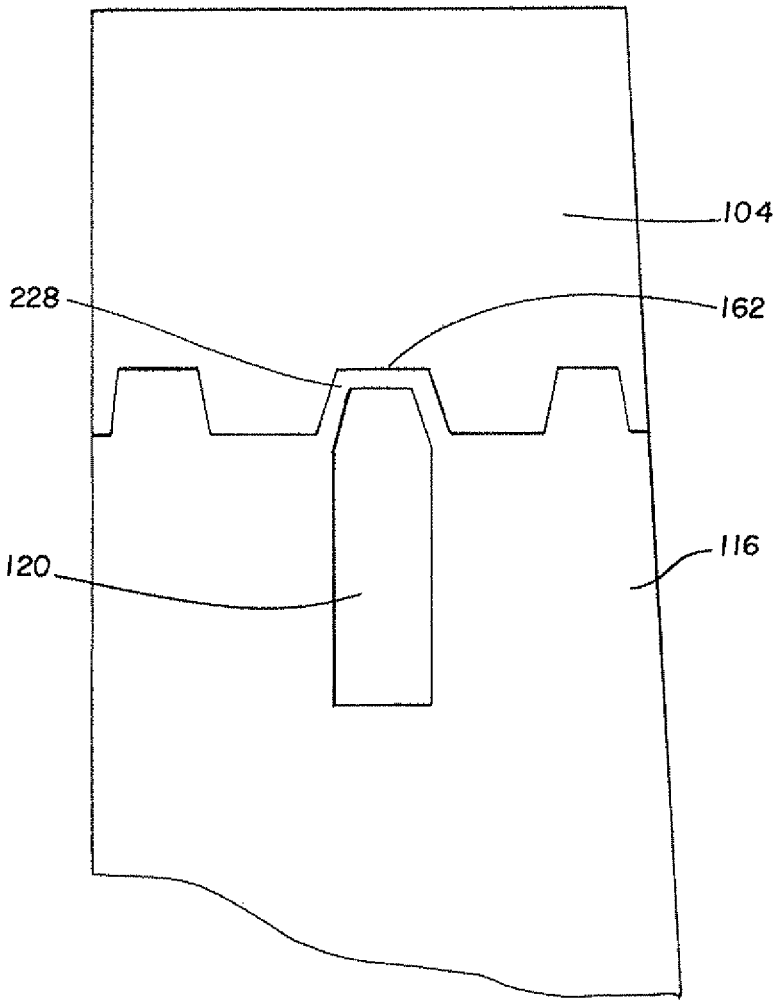
Figure 16E:
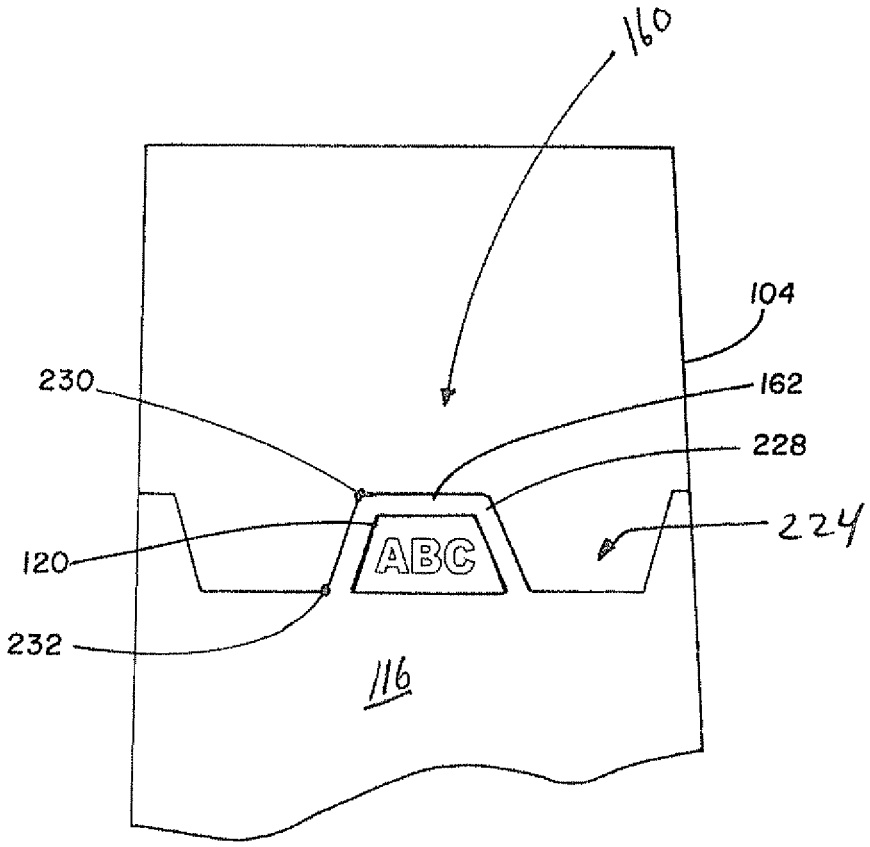
Figure 17:
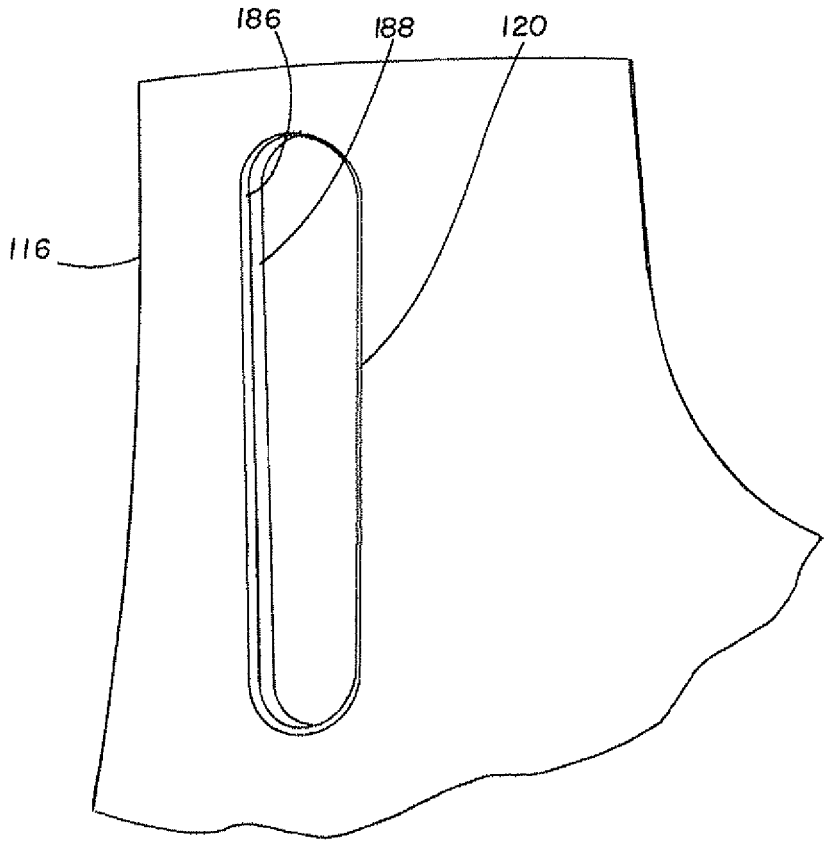
FIG. 17 is a perspective view of a portion of a golf club having an aperture proximate a hosel portion that includes a chamfered edge according to an embodiment.
Figure 18:
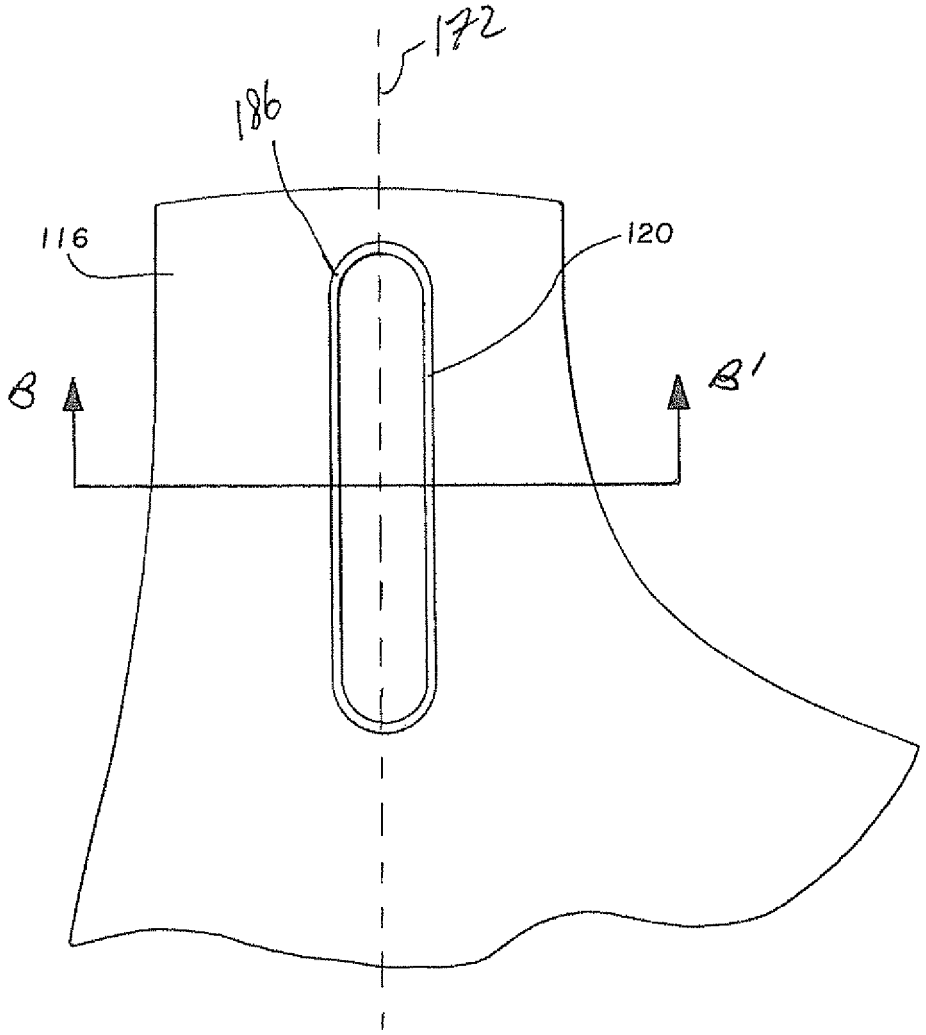
FIG. 18 is a partial side view of a golf club having an aperture proximate a hosel that includes a chamfered edge according to an embodiment.

In an embodiment, as shown in FIG. 15, the rotation inhibiting element 162 includes a plurality of notches 226 that extend downward from a portion of the hosel 116, delimiting plurality of prongs that extend upward from a portion of the hosel 116. For example, the rotation inhibiting element 162 can be castellated. In an embodiment, the rotation inhibiting elements 160 and 162 can cooperate (e.g., mate) with each other to prevent rotation of the shaft sleeve 104, the shaft 178, and/or the shaft assembly 102.

Furthermore, the aperture 120 can also be located at various locations in the hosel 116 as seen, for example, in FIGS. 16(*a*)-16(*e*). As seen in FIGS. 16(*a*) and 16(*b*), the aperture 120 is located adjacent a notch in the rotation inhibiting element 162, and thus is not constrained by a sidewall 190 of the hosel 116 at least proximate an uppermost point 208 of the hosel 208. Specifically, in FIG. 16(*a*), a width of the aperture 120 is no greater than a minimum width of a notch 226*a* of the plurality of notches 226 and, more preferably, less than the minimum width of the notch 226*a*. Alternatively, in some embodiments, as shown in FIG. 16(*b*), the aperture 120 may be wider than a minimum width of the notch 226*b* of the plurality of notches 226. In FIGS. 16(*c*) and 16(*d*), the aperture 120 is located proximate a prong in the rotation inhibiting element 162. In FIG. 16(*d*), the aperture 120 is located adjacent a prong of the rotation inhibiting element 162, and a top end of the aperture 120 is shaped similar to the prong of the rotation inhibiting element. In an embodiment, the aperture 120 is not directly adjacent an uppermost end of the prong 228 of the rotation inhibiting element 162, but instead spaced from the top most end of the prong 228 in order to ensure structural integrity of the rotation inhibiting element 162. In the embodiments shown in each of FIGS. 16(*c*) and 16(*d*), an uppermost point of the aperture is located upward of at a lowermost point of at least one notch 226.

In FIG. 16(*e*), indicia 120 may be placed on the prong 228 of the rotation inhibiting element 162. Preferably, a majority of the planar area of the aperture 120 is located between an uppermost point 230 of the prong 228 of the rotation inhibiting element 162 and the lowermost point 232 of the notch 224 of the rotation inhibiting element 160. More preferably, the aperture 120, in its entirety, is located between the uppermost point 230 of the prong 228 and the lowermost point 232 of the notch 224. Accordingly, in some embodiments, the aperture 120 forms a generally trapezoidal shape that optionally follows the contour of a prong 228 located on an upper portion of the hosel 116.

Figure 19:
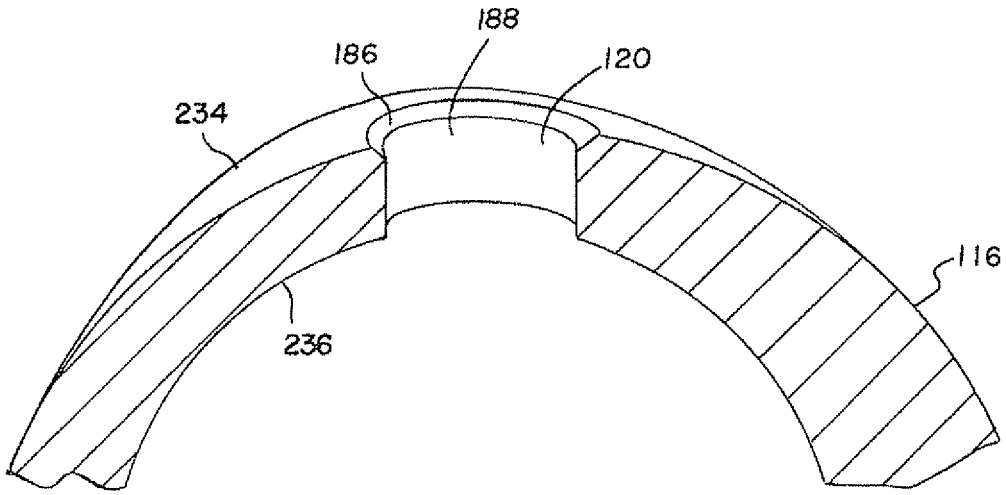
FIG. 19 is a perspective sectional view of a hosel of a golf club having an aperture including a chamfered edge according to an embodiment.
Figure 20:
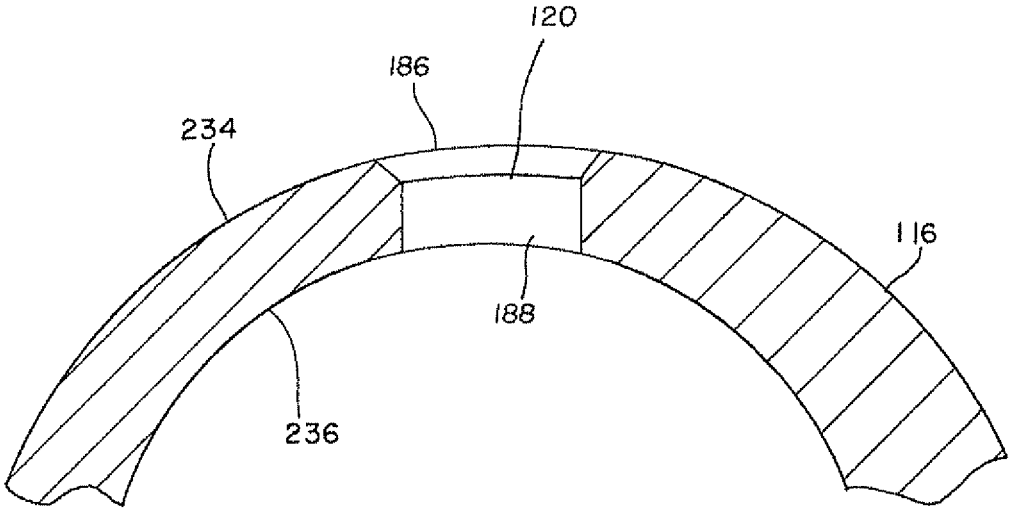
FIG. 20 is a partial cross-sectional view of a hosel of a golf club having an aperture including a chamfered edge according to an embodiment.

In FIGS. 17 through 20, the aperture 120 includes a chamfered edge 186. Preferably, the chamfered edge 186 is located between a hosel outer surface 234, and a hosel inner surface 236. As seen in FIG. 19, which is close-up perspective sectional view of the aperture 120, and in FIG. 20, which is a partial cross-sectional view of FIG. 18 along the line 20-20, the chamfered edge 186 is angled with respect to an inner surface 188 of the aperture 120. The cross-section B-B' passes through an intermediate portion of the aperture 120 and is perpendicular to the hosel axis 172.

Figure 21:
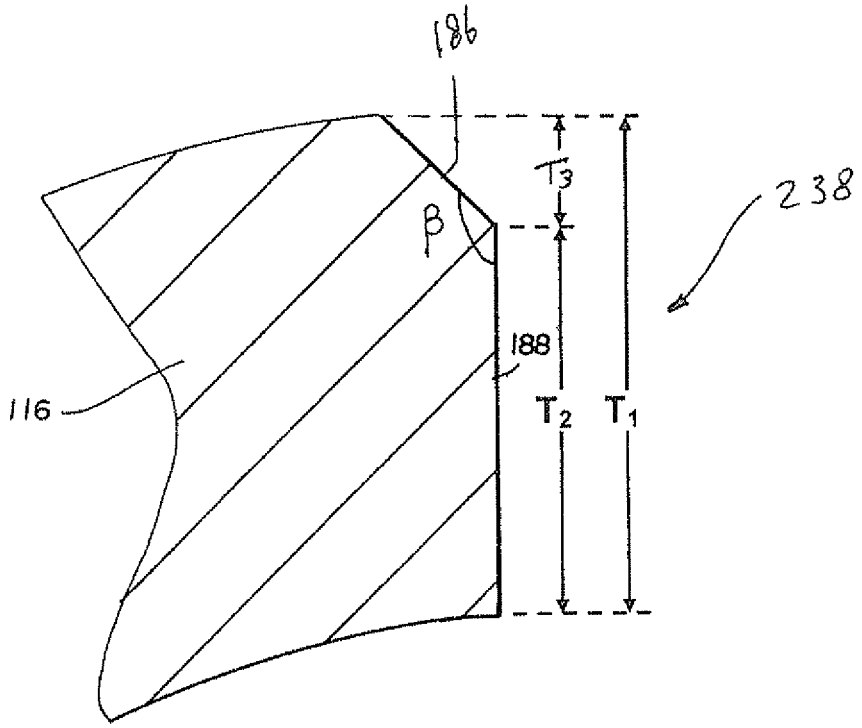
FIG. 21 is a partial cross-sectional view of a hosel of a golf club having an aperture including a chamfered edge according to an embodiment.
Figure 22A:
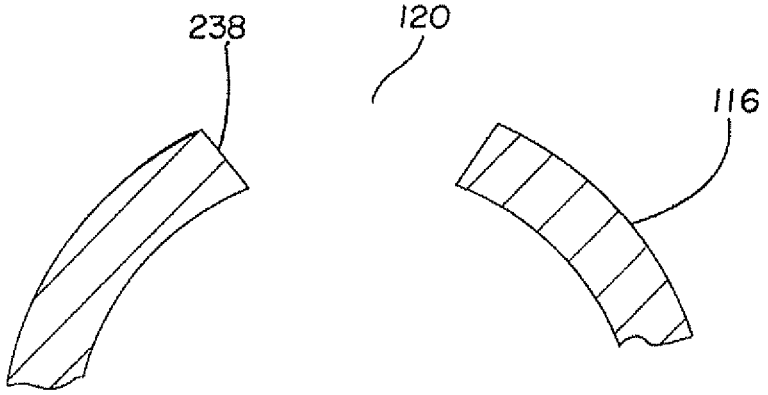
FIGS. 22(*a*)-22(*d*) are partial cross-sectional views of additional embodiments of an aperture proximate a hosel of a golf club.
Figure 22B:
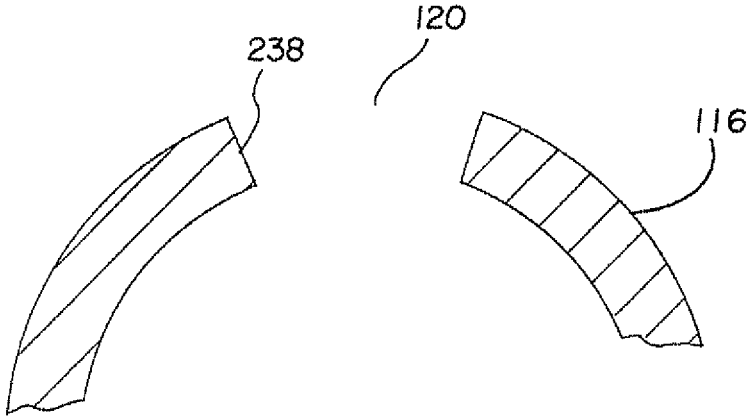
Figure 22C:
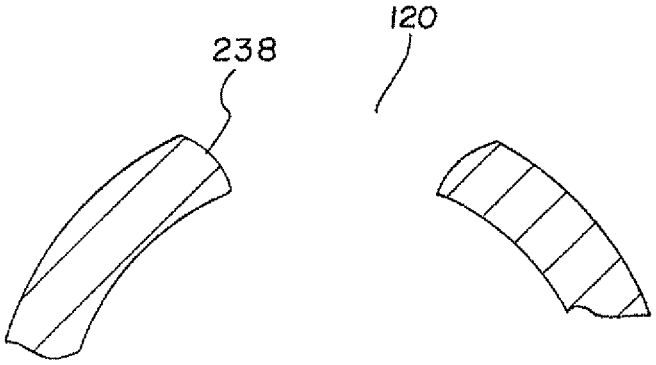
Figure 22D:
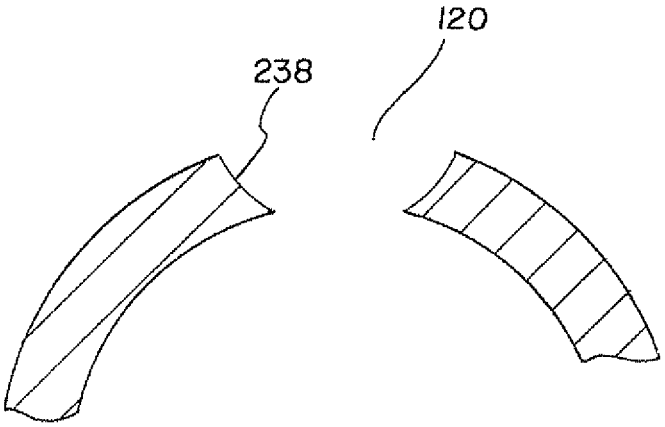

As seen in FIG. 21, the chamfered edge 186 has an angle β with respect to the inner surface 188, measured in cross-sectional plane B-B'. The angle β can be, for example, between about 110° and about 160°, more preferably between about 120° and about 140°, and most preferably between about 125° and about 130°. In an embodiment, the angle β can be selected to increase visibility of any indicia displayed by the aperture 120. In addition, the angle β can be selected to reduce the likelihood of injury due to contact with sharp corners. Furthermore, the angle β can be selected to reduce likelihood that the chamfered edge 186, the inner surface 188, or any other portions of the hosel 116 which forms the aperture 120 may be damaged.

Furthermore, referring to FIG. 21, a sidewall 238 of the hosel 116 may have an overall thickness $T_1$. The inner surface 188 has a thickness of $T_2$ and the chamfered edge 186 has a thickness of $T_3$. As can be seen, $T_2+T_3=T_1$. That is, the thickness $T_2$ of the inner surface 188 and the thickness $T_3$ of the chamfered edge 186 (measured in a radial direction from the hosel axis 172) equal the overall thickness $T_1$ of the sidewall 238 of the hosel 116. In an embodiment, the thickness $T_2$ and the thickness $T_3$ are preferably selected to increase visibility of any indicia displayed by the aperture 120 at least by permitting a greater degree of natural light to pass through the aperture 120 and also to increase the range of eyesight locations capable of viewing indicia displayed through the aperture 120. Further, the thickness $T_2$ and the thickness $T_3$ can be selected to reduce the likelihood that objects may be snagged by the chamfered edge 186 and/or to reduce the likelihood that the chamfered edge 186, the inner surface 188, or any other portion of the hosel 116 which forms the aperture 120 may be damaged.

In an embodiment, the thickness $T_1$ may vary from location to location about the periphery of the aperture 120. In such a case, the ratio of the thickness $T_3$ of the chamfered edge 186 to the thickness $T_1$ of the hosel 116 may be substantially maintained throughout a vertical portion of the hosel 116 containing the aperture 120. The vertical portion of the hosel 116 can include the chamfered edge 186 and the inner surface 188. In an embodiment, the thickness $T_2$ of the inner surface 188 can have a range of approximately 0.72 mm to approximately 1.76 mm. In an embodiment, the thickness $T_3$ can be maintained at approximately 0.24 mm. The thickness $T_1$ may have a range of approximately 0.96 mm to approximately 2.00 mm. In an embodiment, a ratio of $T_2/T_3$ is preferably within the range of approximately 3 to approximately 7.33.

Alternative cross-sectional shapes for the aperture 120 are shown in FIGS. 22(*a*)-22(*d*). Specifically, in the embodiment shown in FIG. 22(*a*), the sidewall 238 follows a linear path that generally diverges in the radial outward direction from the hosel axis 172. In the embodiment shown in FIG. 22(*b*), the sidewall 238 follows a generally linear path that converges in the radial outward direction. In the embodiment shown in FIG. 22(*c*), the sidewall 238 follows a generally arcuate path that is outwardly convex. Alternatively, as shown in FIG. 22(*d*), the side wall 238 may follow an arcuate path that is outwardly concave.

Figure 23A:
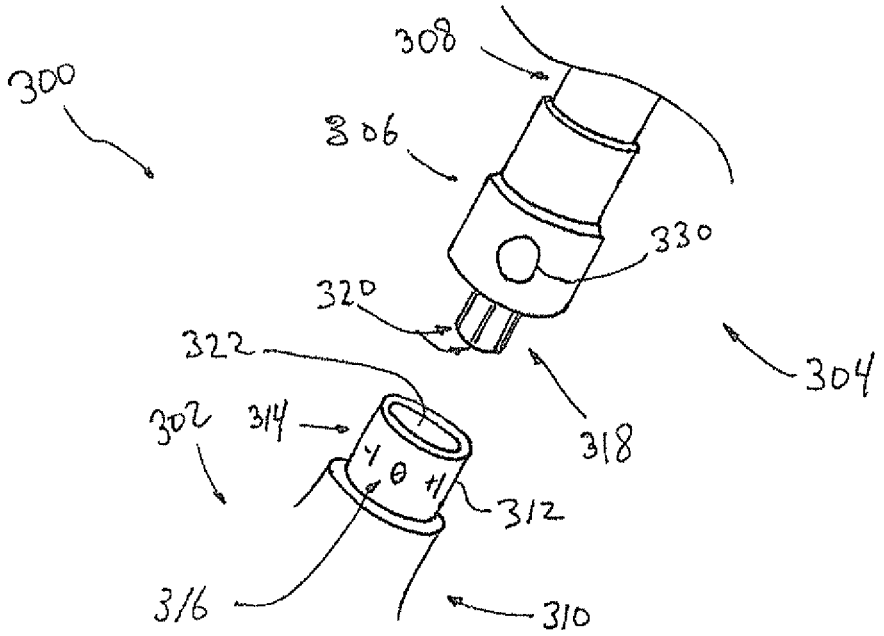
FIG. 23(*a*) is a perspective view of a portion of a golf club in a first position according to an embodiment.
Figure 23B:
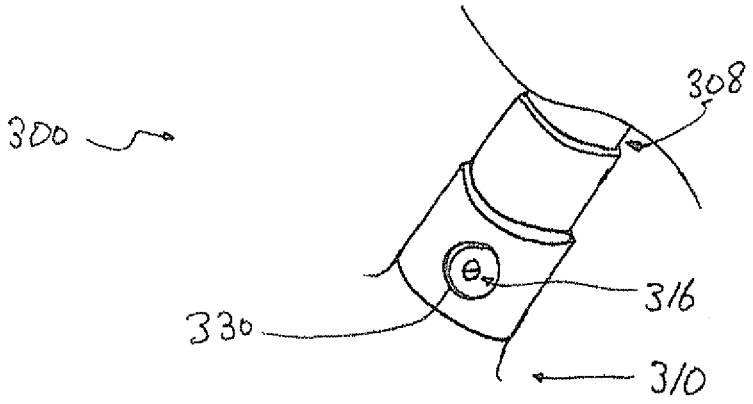
Figure 23C:
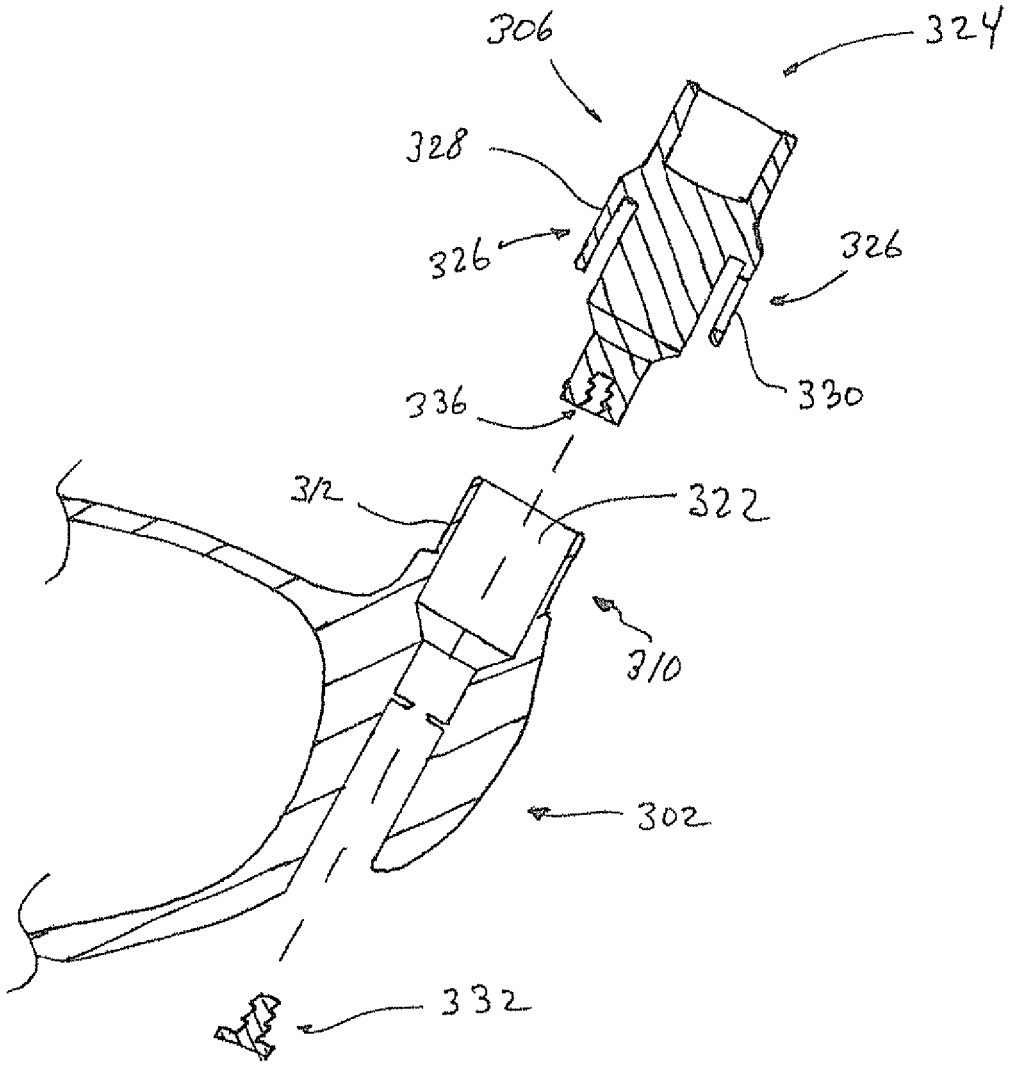

In one or more embodiments, referring to FIGS. 23(*a*) through 23(*c*), a golf club 300 includes a club head 302 and a shaft assembly 304. The shaft assembly 304 includes a shaft sleeve 306 secured to a shaft 308. The golf club head 302 includes a main body having a hosel 310. In this embodiment, the shaft assembly 304 is configured to be removably securable to the hosel 310 of the club head 302. For example, the shaft sleeve 306 includes a rotation-inhibiting element 318 comprising one or more ribs 320 that are elongated generally in the axial direction of the shaft 308. The hosel 310 includes an interior bore 322 that includes a bottom surface and a recess extending downward therefrom (not shown) that includes a contour that is complementary to the contour of the rotation-inhibiting element 318 of the shaft sleeve 306. Alternatively, or in addition, the rotation-inhibiting element 318 comprises a plurality of notches that form therebetween tongs arranged in a castellated formation and wherein the hosel 310 includes a top portion having complementary configuration, as in the embodiments shown in FIG. 15-16(*b*).

As shown in FIG. 23(*a*), the shaft assembly 304 is in a state in which it is dissociated from the club head 302. The shaft assembly 304 is further configured to be fixedly associated with the club head 302 in any of a plurality of positions. This is enabled, e.g., by a shaft assembly 304 in which a shaft axis is angularly offset from a hosel axis when the shaft assembly 304 is in a state in which it is associated with the club head 302 (as in the embodiments of FIGS. 1 through 22(*d*)), as shown in FIG. 23(*b*). The shaft assembly 304 is adapted to be secured within the internal bore 322 of the hosel 310 by association with a securing member (e.g., a screw 332). As shown, the screw 332 includes a threaded exterior surface 334 configured to fixedly engage with a threaded lower recess 336 of the shaft sleeve 306.

The hosel 310 includes an exterior surface 312 that includes a recessed portion 314. The recessed portion 314 includes thereon indicia 316. In some embodiments, the indicia 316 corresponds to an absolute or relative value of face angle, loft angle, and/or lie angle. In some embodiments, the indicia 316 corresponds to a qualitative indication of a characteristic of a position of the golf club 300. Alternatively, or in addition, the indicia 316 include a quantitative indication of a characteristic of a position of the golf club 300. The shaft sleeve 306 further includes an upper recess 324 for receiving the shaft 308 and a shroud 326 for overlapping with, and covering, the portion of the hosel 310 including the indicia 316, when the shaft assembly 304 is associated with the club head 302. In some embodiments, when the shaft assembly 304 is associated with the club head 302, an exterior surface 328 of the shroud 326 is flush with the exterior surface 312 of the hosel 310. However, in alternative embodiments, the exterior surface 328 of the shroud 326 is raised from the exterior surface 312 of the hosel 310. In yet other embodiments, the exterior surface 326 of the shroud 326 is recessed relative to the exterior surface 312 of the hosel 310. Further, in alternative embodiments, the exterior surface 312 of the hosel 310 is not recessed. Thus, in such embodiments, when the shaft assembly 304 is associated with the hosel 310, the combined contour of the exterior surface 312 of the hosel 310 and the exterior surface 328 of the shroud 326 forms a stepped up portion.

The shroud 326 comprises an aperture 330 that, in an operating position, aligns with the indicia 316. Preferably, the aperture 330 is configured to selective display therethrough any of the plurality of positions indicators that constitute the indicia 316. In this manner, the golf club 300 is configured such that the specific indicia that is displayed through the aperture 330 corresponds to the current position of the golf club 300. By including the aperture 330 on the shaft sleeve 306 (as opposed to the hosel 310 itself), manufacturing costs may be reduced, as the aperture 330 may be more easily formed in a casting (or investment casting) process, rather than machined as may be required when associated with a hosel.

The shape of the aperture 330 may be circular, or have any other shape as discussed with regard to the embodiments shown in FIGS. 1 through 22(*d*). Further, the aperture 330, when viewed in cross-section, may have any cross-sectional configuration discussed with regard to the embodiments shown in FIGS. 1 through 22(*d*).

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the disclosure is, therefore, indicated by the appended claims rather than by the foregoing description. All changes which come within the meaning and range of equivalency of the claims are to be embraced within their scope.

What is claimed is:

1. A golf club comprising:

a striking face;

a top portion;

a sole portion opposite the top portion;

a shaft assembly including a shaft having a butt end and a tip end, and a shaft sleeve located at the tip end, the shaft sleeve including indicia; and a hosel extending from the top portion, the hosel including a sidewall, a tip end, an internal bore for receiving the shaft assembly, a hosel axis, and an aperture extending through, and circumscribed by, the sidewall such that the indicia of the shaft sleeve corresponds with the aperture, wherein the aperture has a width greater than or equal to 2 mm and less than 4 mm, wherein the aperture has a top portion and a bottom portion such that at least one of the top portion and the bottom portion, in its entirety, follows a semi-circular path, and wherein the sidewall circumscribing the aperture includes an inner surface having a first thickness T1 in a radial direction from the hosel axis and a chamfered edge having a second thickness T2 in the radial direction, T1/T2 being between approximately 3 and 7.33, and the chamfered edge extending outward of the inner surface to form an interior angle therebetween of between about 110° and 160°.

2. The golf club of claim 1 wherein the aperture is elongated in a direction along the hosel axis.

3. The golf club of claim 2 wherein the aperture has a length less than 22 mm.

4. The golf club of claim 2 wherein the aperture has a width of approximately 3 mm, and a length of approximately 16 mm.

5. The golf club of claim 1 wherein the aperture includes an uppermost point located on a first plane perpendicular to the hosel axis, and the hosel includes an uppermost point located on a second plane, the first plane being parallel to the second plane and separated from the second plane by at least 1 mm, and upward being a direction along the hosel axis toward the tip end of the hosel from the sole portion.

6. A golf club head comprising:

a striking face;

a top portion;

a sole portion opposite the top portion; and a hosel extending from the top portion, the hosel including a sidewall, a tip end, an internal bore configured to removably secure a shaft assembly to the golf club head, a hosel axis, and an aperture extending through, and circumscribed by, the sidewall, wherein the aperture has a width greater than or equal to 2 mm and less than 4 mm, wherein the aperture has a top portion and a bottom portion such that at least one of the top portion and the bottom portion, in its entirety, follows a semi-circular path, and wherein the sidewall circumscribing the aperture includes an inner surface having a first thickness T1 in a radial direction from the hosel axis and a chamfered edge having a second thickness T2 in the radial direction, T1/T2 being between approximately 3 and 7.33, and the chamfered edge extending outward of the inner surface to form an interior angle therebetween of between about 110° and 160°.

7. The golf club head of claim 6 further comprising a throughbore communicating with the internal bore and a bottom surface of the sole portion for accepting a securing member to secure the shaft assembly to the hosel.

8. The golf club head of claim 7 wherein the hosel further includes an exterior surface comprising a threaded portion for association with the securing member.

9. The golf club head of claim 6 wherein the hosel further comprises a rotation inhibiting element.

10. The golf club head of claim 9 wherein the rotation inhibiting element comprises a plurality of grooves elongated in a direction along the hosel axis.

11. The golf club head of claim 9 wherein the rotation inhibiting element comprises a plurality of notches that extends downward from the tip end of the hosel.

12. The golf club head of claim 6 wherein the aperture is elongated in a direction along the hosel axis.

13. The golf club head of claim 12 wherein the aperture has a length less than 22 mm.

14. The golf club head of claim 12 wherein the aperture has a width of approximately 3 mm, and a length of approximately 16 mm.

15. The golf club head of claim 6 wherein the aperture includes an uppermost point located on a first plane perpendicular to the hosel axis, and the hosel includes an uppermost point located on a second plane, the first plane being parallel to the second plane and separated from the second plane by at least 1 mm, and upward being a direction along the hosel axis toward the tip end of the hosel from the sole portion.

16. A golf club comprising:

a striking face;

a top portion;

a sole portion opposite the top portion;

a shaft assembly including a shaft having a butt end and a tip end, and a shaft sleeve located at the tip end, the shaft sleeve including indicia; and a hosel extending from the top portion, the hosel comprising a hosel axis, a sidewall, an internal bore for receiving the shaft assembly, and an aperture extending through the sidewall such that the indicia of the shaft sleeve corresponds with the aperture, wherein the aperture extends in a direction along the hosel axis by a first distance and extends circumferentially to the hosel axis by a second distance that is less than the first distance such that the second distance is greater than or equal to 2 mm and less than 4 mm, wherein the aperture has a top portion and a bottom portion such that at least one of the top portion and the bottom portion, in its entirety, follows a semi-circular path, and wherein the sidewall through which the aperture extends includes an inner surface having a first thickness T1 in a radial direction from the hosel axis and a chamfered edge having a second thickness T2 in the radial direction, T1/T2 being between approximately 3 and 7.33, and the chamfered edge extending outward of the inner surface to form an interior angle therebetween of between about 110° and 160°.

17. The golf club of claim 16 wherein the indicia of the shaft sleeve indicates a position of the golf club when the shaft assembly is associated with the hosel in an operating position.

18. The golf club of claim 17 wherein the aperture is at least partially filled by a non-metallic material.

19. The golf club of claim 18 wherein the non-metallic material is translucent.

20. The golf club of claim 19 wherein the translucent material is configured to magnify the indicia of the shaft sleeve when the indicia is displayed through the aperture.

21. A golf club comprising:

a striking face;

a top portion;

a sole portion opposite the top portion;

a shaft assembly including a shaft having a butt end and a tip end, and a shaft sleeve located at the tip end, the shaft sleeve including indicia;

a hosel extending from the top portion, the hosel comprising a hosel axis, a top section, a sidewall, an internal bore for receiving the shaft assembly, and an aperture having a width greater than or equal to 2 mm and less than 4 mm and extending through the sidewall such that the indicia of the shaft sleeve aligns with the aperture, the aperture having a top portion and a bottom portion such that at least one of the top portion and the bottom portion, in its entirety, follows a semi-circular path, wherein a portion of the sidewall at the top section of the hosel includes an anti-deformation structure configured to reduce deformation of the top section of the hosel, the anti-deformation structure at least partially defining the aperture, and the indicia of the shaft sleeve indicates a position of the golf club when the shaft assembly is associated with the hosel in an operating position by display of the indicia through the aperture, and wherein the sidewall circumscribing the aperture extends includes an inner surface having a first thickness T1 in a radial direction from the hosel axis and a chamfered edge having a second thickness T2 in the radial direction, T1/T2 being between approximately 3 and 7.33, and the chamfered edge extending outward of the inner surface to form an interior angle therebetween of between about 110° and 160°.

22. A golf club comprising a striking face;

a top portion;

a sole portion opposite the top portion;

a shaft assembly including a shaft having a butt end and a tip end, and a shaft sleeve located at the tip end, the shaft sleeve including indicia; and a hosel extending from the top portion, the hosel including a sidewall, an internal bore for receiving the shaft assembly, and an aperture extending through, and circumscribed by, the sidewall such that the indicia of the shaft sleeve corresponds with the aperture, wherein the aperture has an average thickness no greater than 2.5 mm and a width greater than or equal to 2 mm and less than 4 mm, wherein the aperture has a top portion and a bottom portion such that at least one of the top portion and the bottom portion, in its entirety, follows a semi-circular path, and wherein the sidewall circumscribing the aperture includes an inner surface having a first thickness T1 in a radial direction from a hosel axis and a chamfered edge having a second thickness T2 in the radial direction, T1/T2 being between approximately 3 and 7.33, and the chamfered edge extending outward of the inner surface to form an interior angle therebetween of between about 110° and 160°.

23. The golf club of claim 1, wherein the sidewall of the hosel comprises an exterior surface having indicator indicia thereon.

24. The golf club of claim 23, wherein the indicator indicia is located between the aperture and the tip end of the hosel.

* * * * *